US007249541B1

(12) United States Patent
Osborne

(10) Patent No.: US 7,249,541 B1
(45) Date of Patent: Jul. 31, 2007

(54) ONE-HAND FASTENER-STARTING HAMMER ATTACHMENT

(76) Inventor: William George Osborne, 6876 E. Mission St., Yuma, AZ (US) 85365

( * ) Notice: Subject to any disclaimer, the term of this patent is extended or adjusted under 35 U.S.C. 154(b) by 0 days.

(21) Appl. No.: 11/531,617

(22) Filed: Sep. 13, 2006

(51) Int. Cl.
*B25D 1/04* (2006.01)

(52) U.S. Cl. ..... 81/180.1; 81/23

(58) Field of Classification Search ..... 81/180.1, 81/20, 23, 44
See application file for complete search history.

(56) References Cited

U.S. PATENT DOCUMENTS

| | | | | |
|---|---|---|---|---|
| 131,211 | A | 9/1872 | Daugherty | |
| 469,710 | A | 3/1892 | Munn | |
| 640,169 | A | 1/1900 | Bargar | |
| 903,095 | A | 11/1908 | Johnson | |
| 951,646 | A | 3/1910 | Lambert | |
| 1,379,838 | A | 5/1921 | Salomaa | |
| 1,928,268 | A | 9/1933 | Sanders | |
| 2,574,304 | A | 11/1951 | Vigil | |
| 2,652,082 | A * | 9/1953 | Zanelli | 81/23 |
| 2,722,251 | A | 11/1955 | Dillon | |
| 3,125,143 | A | 3/1964 | Wilson | |
| 4,270,587 | A | 6/1981 | Ludy | |
| 4,367,778 | A | 1/1983 | Bradbury | |
| 4,658,679 | A | 4/1987 | Nitzberg | |
| 4,798,107 | A | 1/1989 | Furey | |
| 4,843,925 | A | 7/1989 | Furey | |
| 5,178,048 | A | 1/1993 | Matechuk | |
| 5,852,959 | A | 12/1998 | Speare | |
| 6,282,988 | B1 | 9/2001 | Erickson | |
| 6,571,666 | B1 * | 6/2003 | Te | 81/24 |

* cited by examiner

*Primary Examiner*—Jacob K. Ackun, Jr.

(57) ABSTRACT

This tested invention, for use with an unmodified hammer (402), is a simple attachment (31) whose fastener-receiving region (57), and fastener-holding apparatus (54), along with a magnetism and support extender (542), allow safe, one-handed starting of a wide range of size and types of fasteners (562), including nails, screws, tacks, and staples. With the attachment, a fastener can be easily started with the usual initial hammer swing and then driven to the desired depth by striking it with the hammer face in the conventional manner with an unbroken rhythm. The attaching mechanism (72) enables attaching to and detaching from a hammer with only one hand. Spacers (202), or tailor forming of the attachment body (32), allow it to fit all of the common household hammers. Alternative holding fingers (314, 316, 318 FIG. 20) handle nonmagnetic fasteners.

20 Claims, 26 Drawing Sheets

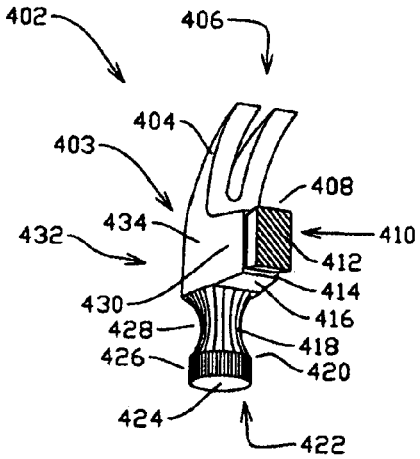
Fig 2A - Prior Art
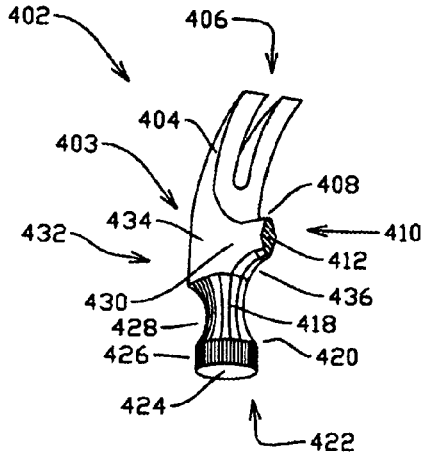
Fig 2B - Prior Art
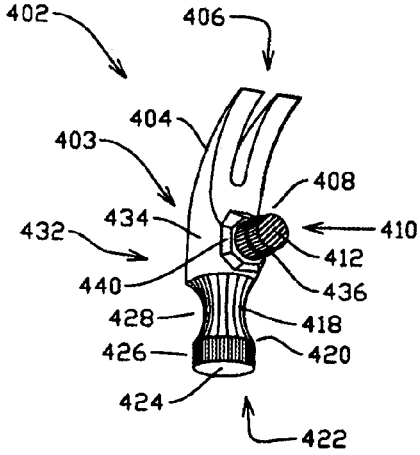
Fig 2C - Prior Art
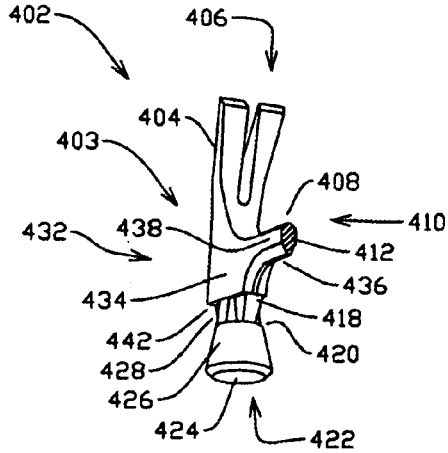
Fig 2D - Prior Art
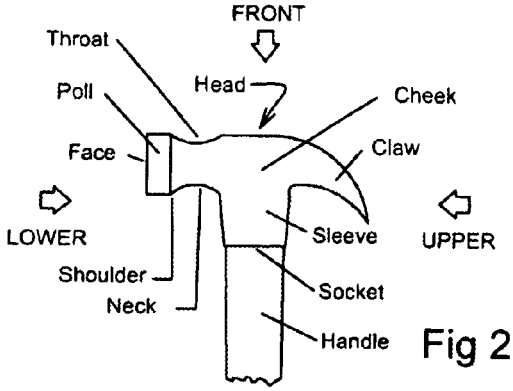
Fig 2E - Prior Art

ONE-HAND FASTENER-STARTING HAMMER ATTACHMENT

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to attachments for unmodified, conventional hammers, specifically to attachments that will allow the starting of a nail, screw, or other fastener, into a work piece with the use of only one hand, and then continuing the hammering of the fastener with virtually no change in the rhythm of the hammer swing.

2. Background of the Invention

In order to help the understanding of the description of the background of this invention, the parts of a conventional hammer are first identified for reference as follows:

Refer to FIG. 2E to locate parts

FRONT
UPPER
LOWER
Head
Cheek
Claw
Sleeve
Socket
Handle
Neck
Shoulder
Face
Poll
Throat.

Generally, the conventional manner used for starting a nail, or other type of fastener, into a work piece (for example a board or other surface) is to hold the nail in one hand against the work piece and then strike the head of the nail with a hammer face to get the nail started. Then, the nail will stand by itself, and can be struck with the hammer, using only one hand, as many times as necessary to complete the driving of the nail into the work piece to the depth desired.

However, there are numerous occasions when one needs to start a nail, or other type of fastener, with the use of only one hand. Such occasions include the following:

1. When working overhead and needing to hold the work piece in position with one hand while using the other hand to start the nail. A specific instance is when installing ceiling drywall.
2. When one wishes to reach a longer distance from one position without the need to reposition oneself. A specific instance is when standing on a ladder leaning against a work area and wishing to place nails to either side farther than can be safely reached with both hands, without the need to climb down from the ladder, reposition the ladder, climb back up the ladder, and place the nail.
3. When one needs to place a nail below the bottom of his feet, but cannot safely reach the area with both hands. A specific instance is when standing on the edge of a roof and needing to drive nails into the facia board.
4. When one needs to place a nail, or other type of fastener, into a narrow space which is not wide enough to accommodate one hand to hold the nail.
5. When one wishes to place a nail, or other type of fastener, where the visibility of the area needed to align the hammer with the fastener is limited.
6. When one wishes to place nails above his head without standing on a ladder, stepstool, scaffolding, or the like, to get high enough to hold the nails with one hand. A specific instance is when placing nails into the area of sheets of drywall on a wall above one's head, but remaining standing on the floor.
7. When one wishes to place nails, or other types of fasteners, that are too short to easily hold with one hand. A specific instance is when placing carpet tacks, or upholstery tacks or staples.
8. When one wishes to place nails, but, for whatever reason, such as the result of an injury, has the use of only one hand.

There exist a number of forms of prior art that allows one to start a nail, or other type of fastener, with the use of only one hand. Many of these achieve this end through the modification of some part of the hammer itself. These are not considered here, since this present invention pertains to an attachment that achieves this end without requiring any modification to any part of the hammer itself.

There exist more than a dozen different forms of prior art that are attachments that allow one to start a nail, or other type of fastener, with the use of only one hand, without requiring any modification of any part of the hammer itself, including the following U.S. patents:

1. U.S. Pat. No. 131,211 to Daugherty (1872).
2. U.S. Pat. No. 469,710 to Munn and Rowe (1892).
3. U.S. Pat. No. 640,169 to Bargar (1900).
4. U.S. Pat. No. 903,095 to Johnson (1908).
5. U.S. Pat. No. 951,646 to Lambert (1910).
6. U.S. Pat. No. 1,379,838 to Salomaa (1921).
7. U.S. Pat. No. 1,928,268 to Sanders (1933).
8. U.S. Pat. No. 2,574,304 to Vigil (1951).
9. U.S. Pat. No. 2,722,251 to Dillon (1955).
10. U.S. Pat. No. 3,125,143 to Wilson (1964).
11. U.S. Pat. No. 4,270,587 to Ludy (1981).
12. U.S. Pat. No. 4,367,778 to Bradbury (1983).
13. U.S. Pat. No. 4,658,679 to Nitzberg, et al (1987).
14. U.S. Pat. No. 4,798,107 to Furey (1989).
15. U.S. Pat. No. 4,843,925 to Furey (1989).
16. U.S. Pat. No. 5,178,048 to Matechuk (1993).
17. U.S. Pat. No. 5,852,959 to Speare (1998).
18. U.S. Pat. No. 6,282,988 to Erickson (2001).

However, all of these prior art forms each have more than several of the following disadvantages, arranged in the following order: safety, convenience, optimum use, range of use, expense, and nails before other fastener types:

1. Attachment not securely attached to hammer and could fly off in use.
2. There is no back-up safety mechanism to prevent the attachment from flying off in the event it becomes detached during use.
3. Attachment securing mechanism is of such a design, and/or employs such a material, that a relatively low number of attachment-detachments would result in the mechanism failing to secure.

4. Repeated attaching and detaching from a hammer would relatively soon lead to fatigue and breakage of the securing mechanism.
5. Attachment is composed, at least in part, of materials possessing low strength or durability properties.
6. Restricted to being used with a limited, in some cases only one, hammer type or shape.
7. Precision requirement of the design and the inevitable increased likelihood that the product will not function in the desired manner, especially with a variety of hammerhead shapes.
8. Attachment fits over the striking face of a hammer and requires that once a nail has been started in the work piece, the attachment must be removed before the hammer can be used to further strike the nail with the face in the conventional manner.
9. Attachment fits over the striking face of the hammer and must be removed if not needed to start the next nail, or other fastener type.
10. An additional step or movement is required to release a nail from the attachment before continuing to hammer the nail into place, preventing a smooth, continuous rhythm in the striking of the nail.
11. Attachment would not hold a nail, or other fastener type, particularly a large one, in all positions of the hammer, especially when the work area is below the user.
12. Requires that a nail be started with some portion of the hammerhead other than the striking face, such as with the cheek area of the head or with the claw area. Then, in order to continue driving the nail in the conventional manner with the striking face of the hammer, one must change the swing by turning the hammer either ninety or 180 degrees.
13. Nail, or other fastener type, must be started with the cheek area of the hammer, thus requiring more than twice the width of area for the swing as that needed when using the face of the hammer in the conventional manner.
14. Use of the attachment is complicated in that it requires the user to place a nail, or other fastener type, in a different portion of the attachment, depending on whether the work area is above or below the user.
15. It would be relatively difficult to insert a nail, or other fastener type, into the attachment.
16. Attachment would be difficult to attach to a hammer.
17. Attachment, if not removed before using the claw to extract a fastener that became bent during starting or driving, or that for some other reason needed to be pulled out, could prevent the claw from grasping the fastener.
18. Attachment, if not removed before using the claw to extract a fastener, could jam or damage the attachment.
19. Attachment would be difficult to remove, and if left in place would interfere with using the claw by marring a work surface.
20. Attachment would be relatively difficult to remove from a hammer, requiring in some cases other tools such as a pair of pliers or a screwdriver.
21. Attachment fits over the striking face of the hammer, and unless removed after starting a nail, receives repeated impact in the driving of the nail, tending to wear or break the attachment prematurely.
22. Contains sharp edges and/or corners that can snag on or abrade or cut the user, his clothing, the hammer holster, other tools, or the toolbox.
23. Contains exposed magnets that can inadvertently attract metallic items when not desired.
24. Magnet used to hold fastener receives repeated impact, leading to loss of magnetism.
25. Attachment can lead to accumulation of residual magnetism by the hammerhead, resulting in the hammer attracting other metallic items when not desired.
26. Complication of the design and/or costly materials requirement, resulting in an increased expense of manufacturing.
27. Expectation of requiring the user to replace a failed, uncommon part, rather than the entire unit, due to cost considerations.
28. Attachment would not accept or hold a broader-bodied or larger-head type fastener, such as a screw.
29. Attachment would not accept or adequately hold a staple.
30. Attachment would not accept or hold, or allow the starting of small, short fasteners.

BACKGROUND OF THE INVENTION—OBJECTS AND ADVANTAGES

Accordingly, several objects and advantages of the present invention are:

1. To provide an attachment that is securely attached to the hammer so that the chances that it will become detached during use are very low.
2. To provide an attachment that has a back-up safety mechanism to prevent the attachment from flying off in the event it becomes detached during use.
3. To provide an attachment that has a securing mechanism of such a design, and employs such a material, that a high number of attachment-detachments would be possible before the mechanism failed.
4. To provide an attachment that would withstand a large amount of attaching and detaching.
5. To provide an attachment that is composed of materials possessing relatively high strength and durability properties.
6. To provide an attachment that can be used with a wide variety of hammer types and shapes, including all of the common household types presently on the market.
7. To provide an attachment that does not require a great degree of precision in design or manufacture, resulting in increased likelihood that the attachment will function in the manner intended.
8. To provide an attachment that can remain on the hammer without interference when continuing to strike a nail with the face in the conventional manner to drive the nail into its final position.
9. To provide an attachment that does not interfere with the starting of the next fastener if it is not needed.
10. To provide an attachment that does not require an additional step or significant movement to release a nail from the attachment before continuing to hammer the nail into place in the conventional manner with a smooth, continuous rhythm in the striking of the nail.
11. To provide an attachment that will hold a large fastener in all positions of the hammer, including when the work area is above, below, or to the side of the user.
12. To provide an attachment that will allow one to continue to swing the hammer in the same plane as that used in the first swing when starting a nail, so that a rhythm is employed when striking the nail with the face to drive it to its final position.

13. To provide an attachment that allows a fastener to be started with the hammer in the conventional striking position, thus requiring less than half the width of area for the swing as that needed when using the cheek of the hammer.
14. To provide an attachment that is simple in that it would require the user to place the fastener in one obvious location every time, regardless of where the work area is relative to the user.
15. To provide an attachment such that the insertion of a fastener is so simple that it can be easily done with one hand.
16. To provide an attachment that is so easy to attach to the hammer that it can be done with one hand.
17. To provide an attachment that can be left attached without interfering with the use of the claw by preventing the claw from grasping the fastener.
18. To provide an attachment that can be left attached without interfering with the use of the claw by jamming or damaging the attachment.
19. To provide an attachment that can be left attached without interfering with the use of the claw by marring a work surface.
20. To provide an attachment that is so easy to remove from a hammer that it can be removed with one hand.
21. To provide an attachment that does not fit over the face and does not receive repeated impacts in the striking of a nail with the face to drive the nail to its final position.
22. To provide an attachment that has smooth edges and corners that will not snag on or abrade or cut the user, his clothing, the hammer holster, other tools, or the toolbox.
23. To provide an attachment that has its magnet completely shielded by nonmagnetic material, except a small recessed area, thus greatly reducing the chance to attract metallic objects when not desired.
24. To provide an attachment that contains a magnet that does not receive repeated impact, leading to loss of magnetism.
25. To provide an attachment that contains nonmagnetic material between its magnet and the hammerhead so that it does not lead to accumulation of residual magnetism by the hammerhead, resulting in the hammer attracting other metallic items when not desired.
26. To provide an attachment that is simple in design and constructed of inexpensive materials, resulting in a low manufacturing cost.
27. To provide an attachment that, in the event of its failure, could be easily replaced in its entirety, because of its low cost.
28. To provide an attachment that would accept and hold a broader-bodied or larger-head type fastener, such as a screw.
29. To provide an attachment that would accommodate staples.
30. To provide an attachment that would accept and hold, and allow the starting of small, short fasteners, including carpet tacks.

Further objects and advantages are to provide an attachment that is easy and convenient to use and to store, and which could be supplied in one package containing the attachment and spacers that allow use with all of the common household hammers; or with the spacers packaged separately from the attachment; or with separate attachments, each built to fit the different hammers, and with each packaged separately. Still further objects and advantages will become apparent from a consideration of the ensuing description and drawings.

SUMMARY

In accordance with the present invention a one-hand fastener-starting hammer attachment comprises a body that can be attached to a hammer. The body provides a method of holding a fastener, such as a nail, so that a user can start the fastener in a work piece with the use of only one hand.

DRAWINGS—FIGURES

In the drawings, closely related figures have the same number but different alphabetic suffixes.

FIG. 2A depicts a prior art, conventional, nonmetal-handled claw hammer in partial, perspective view from the back, lower, left-hand corner.

FIG. 2B depicts a prior art, conventional, flat-handled claw hammer in partial, perspective view from the back, lower, left-hand corner.

FIG. 2C depicts a prior art, conventional, tubular-handled claw hammer in partial, perspective view from the back, lower, left-hand corner.

FIG. 2D depicts a prior art, narrow-headed claw hammer in partial, perspective view from the back, lower, left-hand corner and FIG. 2E depicts the parts of a prior art conventional hammer.

DRAWINGS—REFERENCE NUMERALS

Figure 1A:
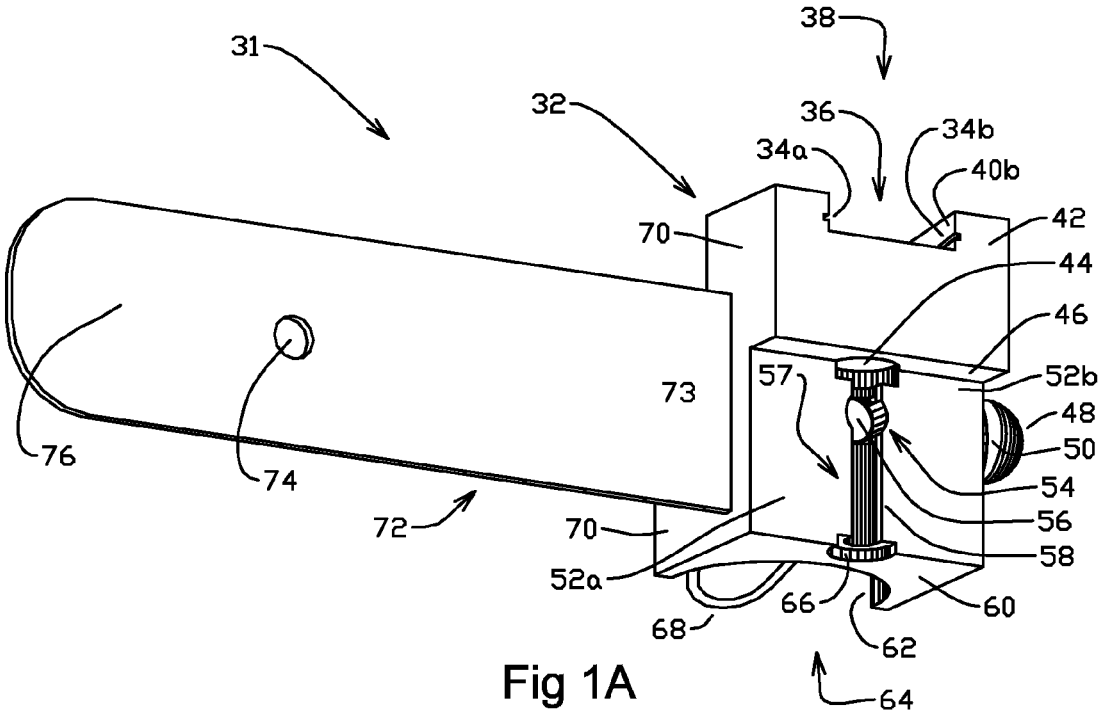
FIG. 1A shows the attachment in perspective view from the front, lower, left-hand corner.

31-198 Series—Attachment
31 attachment
32 attachment body
32*a* alternative additional attachment body or analogous attaching piece
32*b* alternative attachment body to fit flat-handled hammer
32*c* alternative attachment body to fit tubular-handled hammer
32*d* alternative attachment body to fit narrow-headed hammer
34 spacer-guiding groove
36 trapezoidal box or sleeve/spacer receiving area
38 upper or top end
40 receiving area side (part of second surface or surface two)
42 attachment upper, front face
44 fastener-head pocket
44*a* additional alternative fastener-head pocket
44*b* second additional alternative fastener-head pocket
44*c* third additional alternative fastener-head pocket
46 attachment horizontal face
48 hook
50 hook lip
52 attachment lower, front face
54 fastener-holding apparatus or fastener-handling unit
54*a* additional alternative fastener-holding apparatus or fastener-handling unit
54*b* second additional alternative fastener-holding apparatus or fastener-handling unit
54*c* third additional alternative fastener-holding apparatus or fastener-handling unit
56 magnet
56*a* additional alternative magnet
56*b* second additional alternative magnet
56*c* third additional alternative magnet
57 fastener-receiving region or fastener-accepting area
57*a* additional alternative fastener-receiving region or fastener-accepting area
57*b* second additional alternative fastener-receiving region

58 groove or slot
58*a* additional alternative groove or slot
60 attachment bottom face
62 poll girdle (part of first surface or surface one)
64 lower or bottom end
66 slot mouth
66*a* additional alternative slot mouth
68 safety cord
70 attachment left side
72 attaching mechanism or connecting apparatus or strap or band
73 strap end
74 strap hole
76 outer strap end
78 attachment upper, top face
80 receiving area bottom face (part of second surface or surface two)
82 spacer-locking dimple
83 receiving area lower corners (part of second surface or surface two)
84 attachment upper, back face (part of second surface or surface two)
86 attachment back, horizontal face
88 attachment lower, back face
90 girdle shoulder (part of first surface or surface one)
92 attachment right side
94 safety cord end connection point
200 Series—Attachment Spacers
202 hammer-to-attachment spacer
204 spacer upper portion
206 hammer-handle cradle
208 cradle surface (part of spacer second surface)
210 spacer front face
212 spacer upper face
214 spacer-guiding ridge
216 spacer bottom face (part of spacer first surface)
218 bump
220 spacer lower portion
221 spacer lower corners (part of spacer first surface)
222 spacer side (part of spacer first surface)
224 spacer upper side
226 spacer top face
228 spacer back face
230 lower front face
232 lower bottom face
234 holding finger
236 holding arm
238 arm back face
240 finger side face (part of spacer second surface)
242 finger top face (part of spacer second surface)
300 Series—Other Embodiments
302 alternative attaching screw-type strap clamp
304 attaching clamp strap
306 attaching clamp screw
308 alternative attaching mechanism or connecting apparatus
310 alternative bolt
312 alternative nut
314 alternative large-fastener, fastener-holding apparatus, or fastener-handling unit, or flexible holding fingers insert
316 alternative medium-fastener, fastener-holding apparatus, or fastener-handling unit, or flexible holding fingers insert
318 alternative small-fastener, fastener-holding apparatus, or fastener-handling unit, or flexible holding fingers insert
320 alternative insert notch
322 alternative inserts-receiving opening
400 Series—Prior Art Hammer
402 prior art claw hammer
403 head
404 claw
406 upper end or portion
408 handle
410 rear or back portion
412 cut-off section of handle
414 handle eye or socket or sleeve end
416 sleeve bottom
418 neck
420 poll shoulder
422 lower or bottom end or portion
424 striking face
426 poll
428 throat
430 handle sleeve
432 front portion
434 cheek
436 handle bottom
438 handle side
440 handle-head junction
442 throat notch
500 Series—Prior Art Fasteners
502 prior art, 16d common, nail-type fastener
504 16d common nail shank
506 16d common nail head
512 prior art, 1½" drywall, nail-type fastener
514 1½" drywall nail shank
516 1½" drywall nail head
522 prior art, #10 3" flat wood, screw-type fastener
524 #10 3" flat wood screw shank
526 #10 3" flat wood screw head
532 prior art, #10 1½" flat wood, screw-type fastener
534 #10 1½" flat wood screw shank
536 #10 1½" flat wood screw head
542 prior art, cut-off 16d sinker, magnetism and support extender
544 16d sinker extender shank
546 16d sinker extender head
552 prior art, #6 fine drywall, screw-type fastener
554 #6 fine drywall screw shank
556 #6 fine drywall screw head
562 prior art, #6 carpet/upholstery tack, nail-type fastener
564 #6 carpet/upholstery tack shank
566 #6 carpet/upholstery tack head
572 prior art, #5 wire cloth staple, nail-type fastener
574 #5 wire cloth staple shank
576 #5 wire cloth staple head
582 prior art, 10d box, nail-type fastener

DETAILED DESCRIPTION—FIGS. 1A TO 1D—PREFERRED EMBODIMENT

Figure 1B:
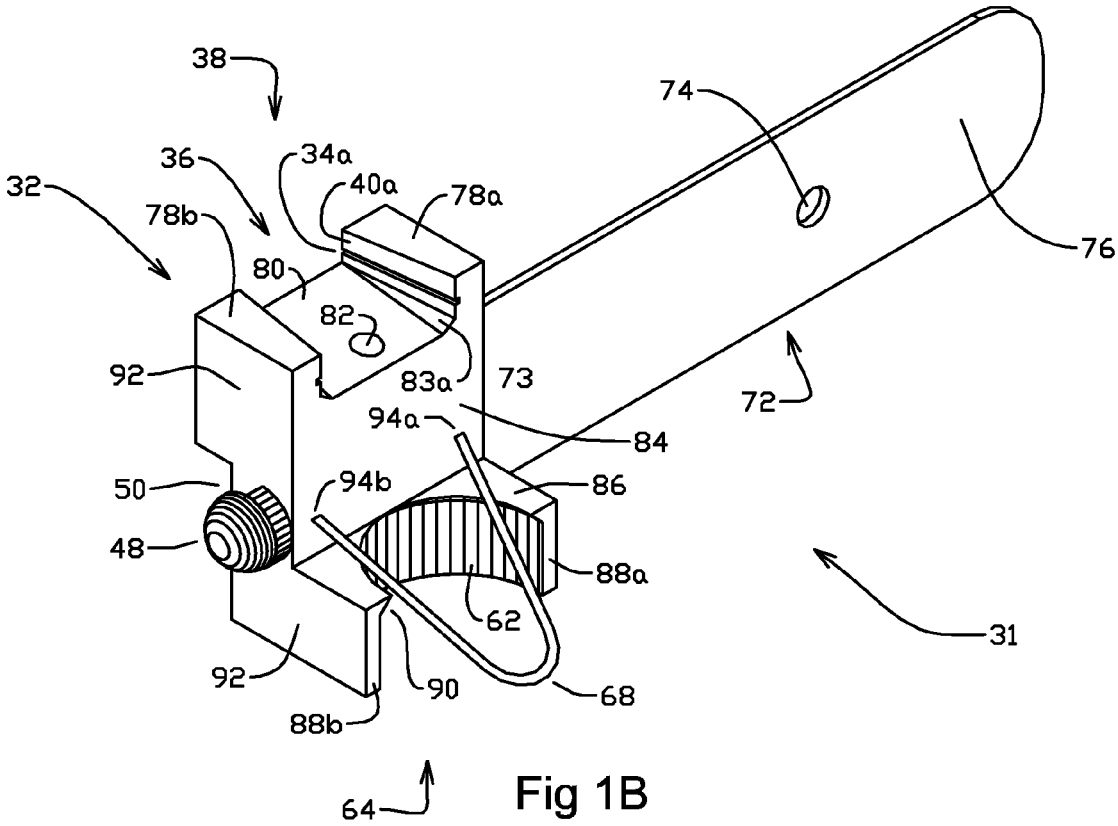
FIG. 1B shows the attachment in perspective view from the back, upper, left-hand corner.
Figure 1C:
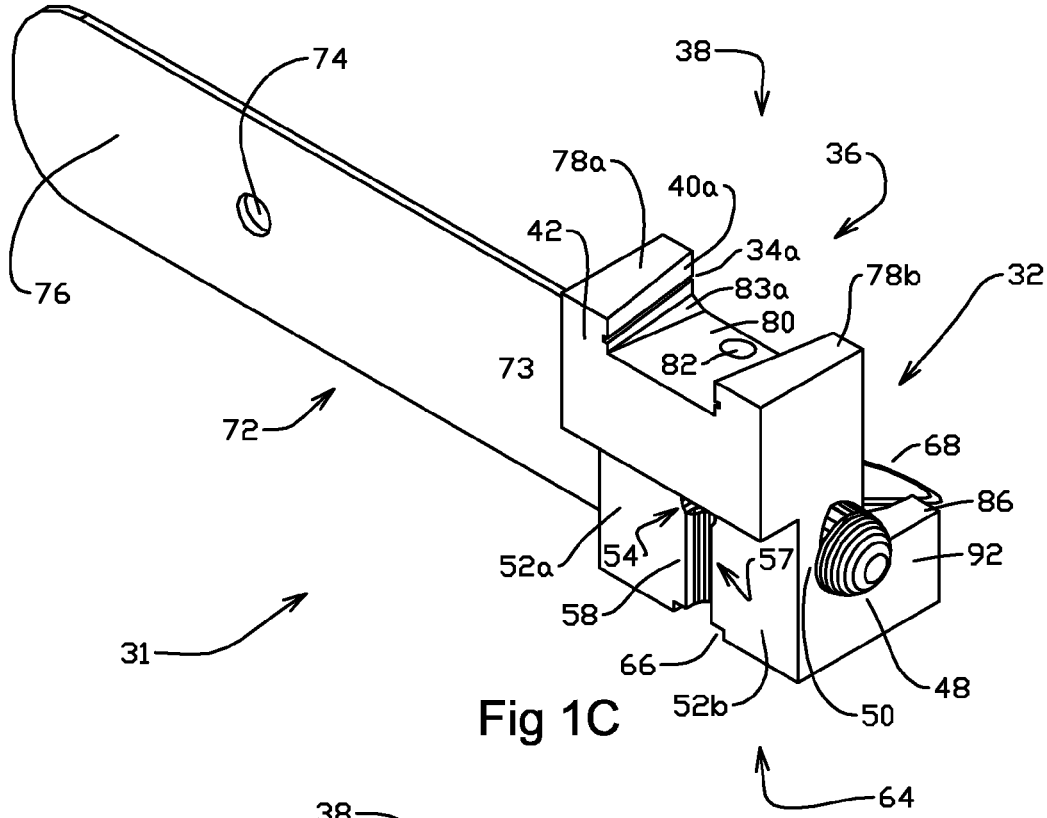
FIG. 1C shows the attachment in perspective view from the front, upper, right-hand corner.
Figure 1D:
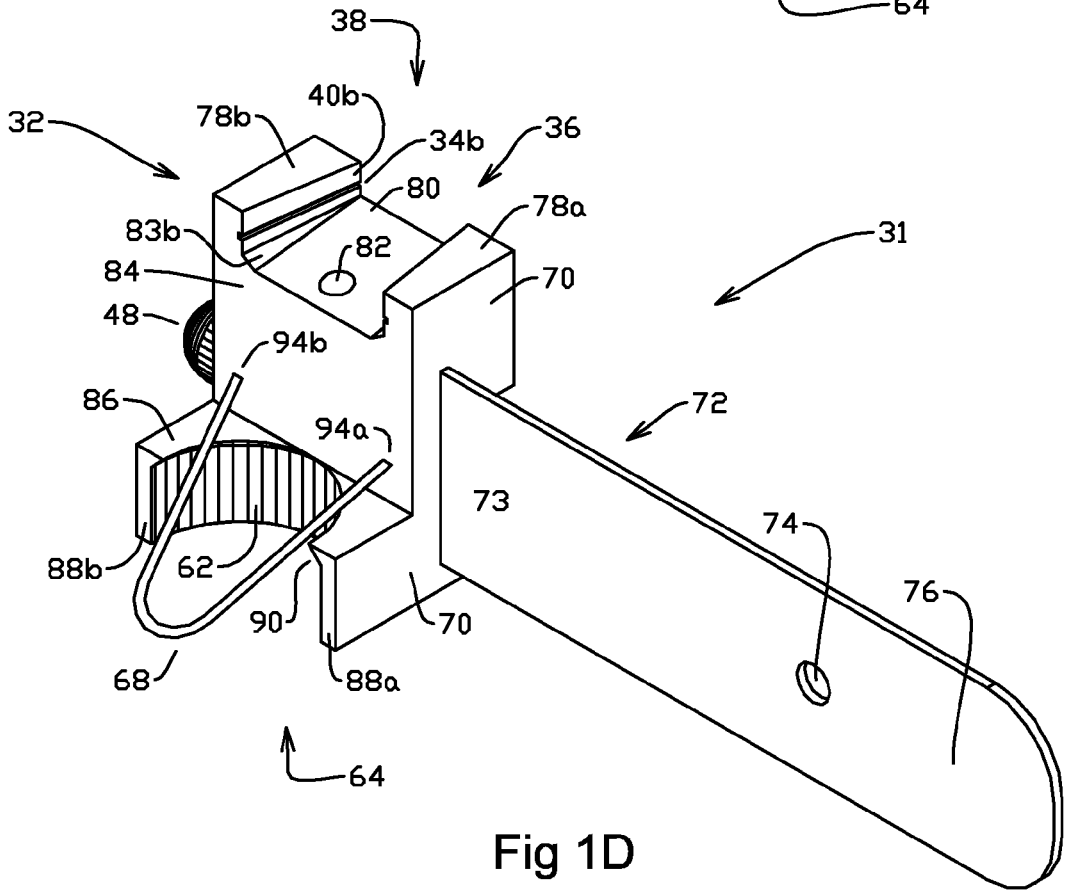
FIG. 1D shows the attachment in perspective view from the back, upper, right-hand corner.

A preferred embodiment of the attachment of the present invention is illustrated in FIG. 1A (perspective view from the front, lower, left-hand corner), FIG. 1B (perspective view from the back, upper, left-hand corner), FIG. 1C (perspective view from the front, upper, right-hand corner), and FIG. 1D (perspective view from the back, upper, right-hand corner). In the preferred embodiment, the attachment body 32 is made of a tough, hard, non-brittle, polyurethane plastic, such as Poly 1510, produced by Polytek® Development Corp of Easton, Pa. and cast into the shown shape. However, the body could be machined or stamped and could consist of any resilient, nonmagnetic material that can be shaped, such as wood, rubber, copper, brass, aluminum, other plastics, resins or other composite material or alloys. The preferred embodiment is made by casting into flexible, high tear strength mold material, such as the silicone rubber PlatSil® 71-20, also produced by Polytek® Development Corp.

Looking at FIG. 1A, the attachment 31 has a body 32 and an upper or top end 38 and a lower or bottom end 64. All of the body's outer planar surfaces are orthogonal. The overall height is 1 15/16 inches. It has a lower, front face 52 that is 1½ wide by 1 1/16 inch high. This face has a fastener-receiving region or fastener accepting area 57, which contains a groove or slot 58 whose axis runs vertically along the center of the face. The slot in cross section is the result of a 3/16 inch-diameter circle's tangent points intersecting a 3/16-inch wide by 1/16-inch deep rectangle, whose edge is coincident with face 52. This slot, in the preferred embodiment, serves as the fastener-receiving region.

In the preferred embodiment, a fastener-holding apparatus or fastener-handling unit 54 includes a magnet 56, of appropriate strength, size, and shape needed to hold a large fastener at any angle. The magnet is firmly affixed to the attachment within a cast, cylindrically shaped receptacle, whose center is located along the axis of the slot 25/32 inch from the lower edge of face 52. The magnet used in the preferred embodiment is a ¼ inch long, ¼ inch diameter, cylindrically shaped, neodymium disc magnet having a maximum energy product grade of 35.0 mega-gauss oersteds, such as the ND283N-35, manufactured by The Magnet Source™ of Castle Rock, Colo. One end of the magnet is affixed within the cast receptacle with a metal/plastic adhesive, such as GOOP®, produced by Eclectic Products, Inc. of Pineville, La. The outer face of the magnet is located such that it is flush with the back edge of the fastener-receiving slot 58.

A fastener-head pocket 44 is placed at the upper end of the fastener-receiving slot in the horizontal face 46 that connects the lower, front face 52 with the upper, front face 42. The horizontal face is 1½ inches wide by 9/32 inch deep. The upper front face has overall dimensions of 1½by ⅞ inches. The head pocket in the preferred embodiment is a 7/16-inch diameter, cylindrical hole approximately 1/32 of an inch deep in face 46. Its axis is parallel to and aligned with the axis of slot 58, with its front edge 3/64 inch behind face 52. The pocket's cylindrical shape extends an additional 3/32 inch downward from face 46 towards the lower end of the attachment into the upper portion of face 52.

A slot mouth 66 is located at the lower end of the fastener-receiving slot 58. The mouth cross section is the result of a ⅜ inch-diameter circle's tangent points intersecting a ⅜-inch wide by 1/16-inch deep rectangle, whose edge is coincident with face 52. The mouth's lower edge is coincident with the bottom face 60 of the attachment and its vertical depth is 1/16 inch. An attaching mechanism or connecting apparatus, in the preferred embodiment a strap or band 72, is connected to the left side 70 of the attachment body. This left side has a top width of 49/64 inch and a bottom width of 1 1/16 inch. The strap is approximately 1/16 inch thick, 1¼ inch wide, and is made of an elastic, rubber-like material. Butyl rubber with a Shore A hardness of about 50, tensile strength of about 1500 pounds per square inch, an elongation of about 700 percent, and a tear strength of about 175 pounds per inch is used in the preferred embodiment. These are roughly the properties of a typical bicycle inner tube. However, the strap could be made of any suitable material that would serve to secure the attachment to a prior-art hammer, such as leather, cloth, plastic, hook-and-loop material, or metal. One end 73 of the strap is fixed firmly to the attachment body by a suitable means, in this case by its perforated end having been extended into the mold and becoming embedded into the body casting. A ¼-inch diameter hole 74 is made along its long central axis at 2 13/16 inches from the side of the body. The strap protrudes from the attachment side approximately 4⅝ inches. At its outer end is a grasping area 76. The long axis of the strap is located approximately 51/64 inch up from the lower edge of side 70 and is centered from front to back at the midpoint of the narrow portion of side 70, which is about 31/64 inch wide.

An attaching site, in the preferred embodiment a hook 48, is located on the right side (92 in FIG. 1B). The hook has a lip 50 on its front side.

There is a back-up safety cord 68 connected to the upper back face (84 in FIG. 1B).

A trapezoidal box or sleeve/spacer receiving area 36 is set into the upper portion of the attachment. Spacer-guiding grooves 34*a* and 34*b* are located on the sides 40*a* and 40*b* of the receiving area.

FIG. 1B shows the ends of the safety cord 68 connected to the upper, back face 84 at points 94*a* and 94*b*. In the preferred embodiment, these ends are connected to the attachment in a similar fashion as the attaching strap—the knotted ends having been extended into the mold and becoming embedded into the attachment body casting. The centers of these connection points are located ¼ inch in from the outside edges and ¼ inch above the face 86, which is parallel to and 19/32 inch above face 60.

The hook 48 is made a part of the attachment body in the casting process. The hook is in the shape of a modified cylinder, topped with a dome. The circular portion of the modified cylinder and the base of the dome have a diameter of approximately 15/32 inch. The back edge of the hook is coincident with the edge of face 84. The center of the hook is aligned with the long axis of the attaching strap 72. The dome base portion of the hook extends out beyond the front of the modified cylinder portion approximately 5/32 inch, forming the lip 50 of the hook.

The sleeve/spacer receiving area 36 is centered on the upper face 78 of the attachment and is notched from the upper front face 42 to the upper back face 84. The sides 40 are vertical with the front height about 7/32 inches and the back height about 9/32 inches. The bottom face 80 of the receiving area is sloped downward ⅛ inch from the front to the back. The lower corners 83 of the sides are chamfered from the front towards the back. The front opening of the receiving area is approximately 7/32 by 13/16 inch. The rear opening is about 1 1/16 inch wide at the top.

The spacer-guiding grooves 34*a* and 34*b* are approximately 1/32 by 1/32 inches in cross section. Their top edges at the front are about ⅛ inch from the upper face 78. In the preferred embodiment, the grooves are slightly inclined towards the back, with their top edges in the back about 5/32 inches from the upper face.

A spacer-locking dimple 82 is located on the front-to-back axis of face 80, its center 5/32 inches from face 84. The dimple is 3/16 inch in diameter with a depth of 1/32 inch.

The back-up safety cord 68 has a total exposed length of approximately 3⅞ inches, and a diameter of about 1/16 inch. In the preferred embodiment, the cord is a #18 contractors' premium braided nylon mason twine made for The Lehigh Group, Macungie, Pa. However, it could be made of any material that would serve the purpose of safely keeping the attachment from flying off in the event that the attaching strap failed.

A cylindrical surface or poll girdle 62 is formed into the lower, back portion of the attachment. The girdle is a bisected, ½-inch high, 41/64-inch radius cylinder, whose vertical edges are connected to the lower, back face 88 by 1/32-inch wide planes parallel to the side faces 70 and 92.

A 45-degree beveled girdle shoulder 90 connects the upper edge of the girdle to the horizontal face 86. The shoulder extends up and out from the upper girdle edge 3/32 inch.

FIGS. 1C and 1D show the attachment and reference items from different points of view to better understand the design.

FIGS. 2A through 2D—Prior Art Hammers

FIGS. 2A through 2D depict the four most common prior art, conventional nail hammers found on the market and in use today. These hammers are not modified or altered in any way.

FIG. 2A depicts a prior art, conventional, nonmetal-handled claw hammer 402 in partial, perspective view from the back, lower, left-hand corner. This is the most common, conventional hammer found on the market and in use today. It has an upper end 406 and a lower or bottom end 422. It has a front portion 432. It has a rear or back portion 410. That portion of the hammer including everything except the handle is herein generally referred to as the head 403. Only a short section of handle 408 is included, with its cut-off section shown as 412. The handle is secured in an eye or socket or sleeve end 414 within a handle sleeve 430. The sleeve bottom is labeled 416. The portion adjoining the sleeve bottom in the lower part of the head is referred to as the neck 418. The cylindrical portion below the neck is called the poll 426. Where the poll joins the neck is referred to as the poll shoulder 420. The bottom end of the poll is called the striking face 424. The front portion of the neck is referred to as the throat 428. The side portion of the head is referred to as the side or cheek 434. The upper, two-pronged portion is referred to as the claw 404.

FIG. 2B depicts a prior art, conventional, flat-handled claw hammer 402 in partial, perspective view from the back, lower, left-hand corner. This is the second most common, conventional hammer found on the market and in use today. It has all of the same corresponding parts as shown in FIG. 2A, except for the following: It has no handle socket or handle sleeve. The handle 408 is an integral part of the hammer. The areas where the handle joins the neck and where it joins the cheek are referred to as the handle bottom 436 and the handle side 438 respectively.

FIG. 2C depicts a prior art, conventional, tubular-handled claw hammer 402 in partial, perspective view from the back, lower, left-hand corner. This is the third most common, conventional hammer found on the market and in use today. It has all of the same corresponding parts as shown in FIG. 2B, except for the following: The tubular handle is connected to the head, and the area where the handle 408 joins the head is referred to as the handle-head junction 440.

FIG. 2D depicts a prior art, narrow-headed claw hammer 402 in partial, perspective view from the back, lower, left-hand corner. This is a relatively recent claw hammer found on the market today. It has all of the similar corresponding parts as shown in FIG. 2B, except for the following: Its construction is such that a throat notch 442 is formed where the throat joins the front portion of the head.

FIGS. 3 through 10—Attachment Shown with FIG. 2A Hammer

Figure 3:
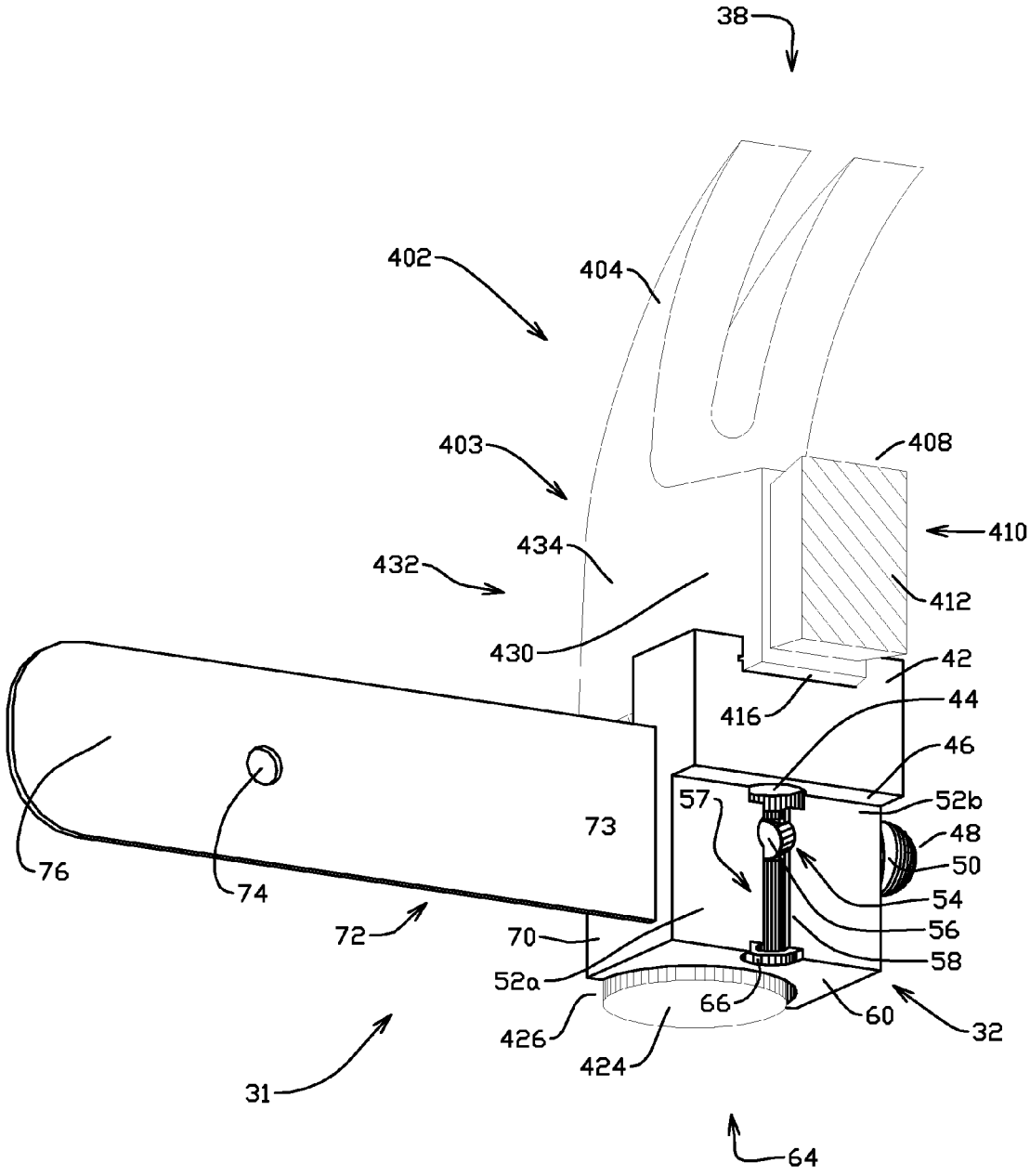
FIG. 3 shows the attachment fitted against a prior art, conventional, nonmetal-handled claw hammer in perspective view from the front, lower, left-hand corner.

FIG. 3 shows the attachment body 32 fitted against 402, the FIG. 2A, prior art, conventional, nonmetal-handled claw hammer in perspective view from the front, lower, left-hand corner. The attachment's receiving area sides 40*a* and 40*b* and bottom face 80 of the sleeve/spacer receiving area 36 (FIG. 1) are fitted against the hammer's handle sleeve 430 and sleeve bottom 416 respectively. The poll girdle 62 (FIGS. 1B and 1D) is fitted against a portion of the hammer poll 426.

Figure 4:
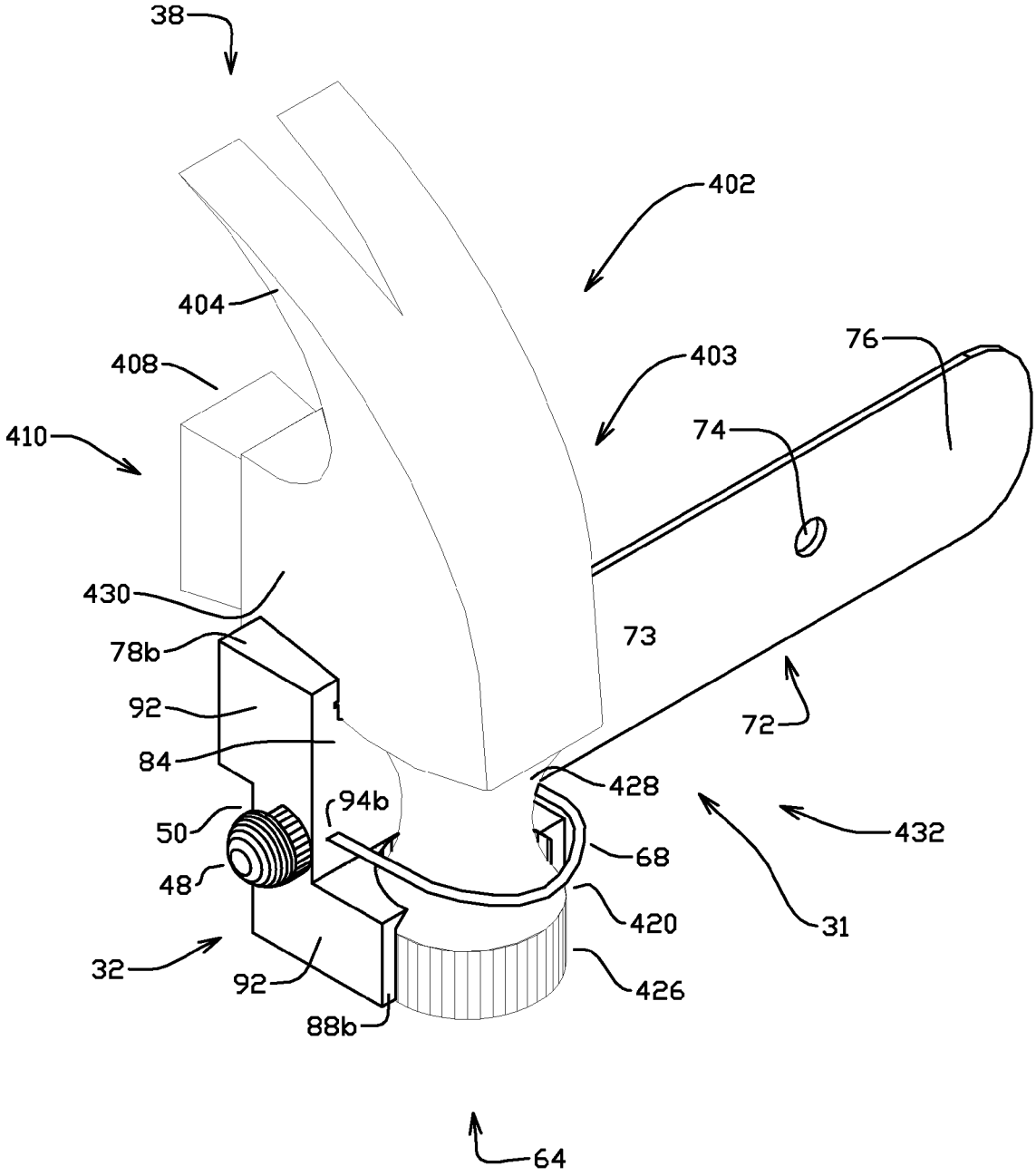
FIG. 4 shows the attachment fitted against a prior art, conventional, nonmetal-handled claw hammer in perspective view from the back, upper, left-hand corner.

FIG. 4 shows the attachment body 32 fitted against 402, the same FIG. 2A, prior art, conventional, nonmetal-handled claw hammer in perspective view, but from the back, upper, left-hand corner. In this view, it can be seen that the hammer poll 426 has been inserted through the attachment's back-up safety cord 68 before the hammer's handle sleeve is slid into the sleeve/spacer receiving area 36 and before the poll is fitted against the poll girdle 62. Also in this view it can be seen that the poll girdle and the girdle shoulder 90 (FIG. 1B), which form a first surface or surface one, fit about a portion of the head of the hammer where the neck and the throat join the poll. Additionally, from this view it can be seen that the receiving area side 40, the receiving area bottom face 80, the receiving area bottom corners 83, and the attachment upper back face 84 (FIG. 1B), which form a second surface or surface two, fit about a portion of the head of the hammer where the upper portion of neck and throat join the rest of the hammer head.

Figure 5:
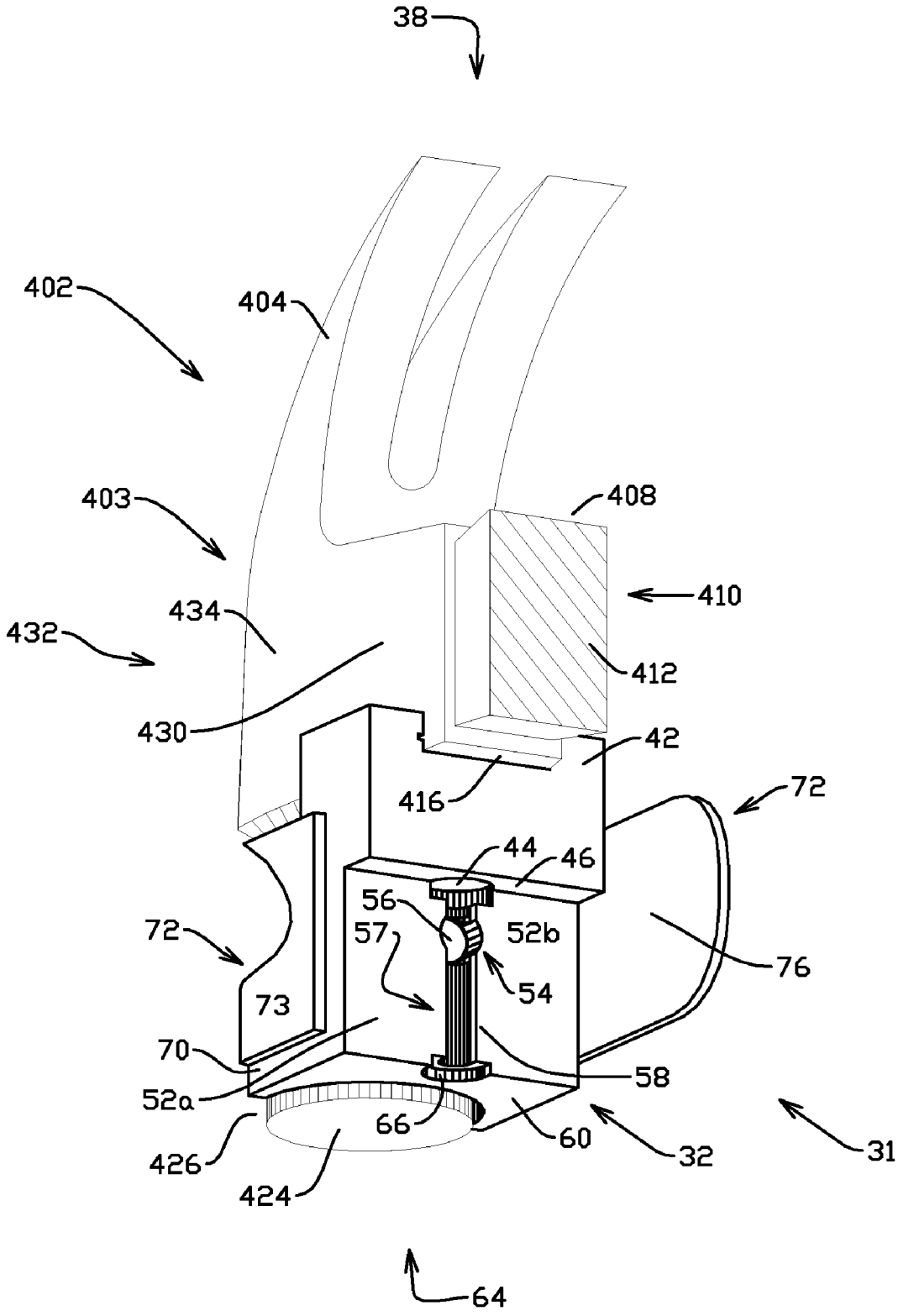
FIG. 5 shows the attachment attached to a prior art, conventional, nonmetal-handled claw hammer in perspective view from the front, lower, left-hand corner.

FIG. 5 shows essentially the same view as that of FIG. 3, except that the attachment 31 has been attached to the prior art hammer 402. The attaching strap 72 has been wrapped around the throat 428 of the hammer, and the hole 74 has been pulled over the hook 48 so that the attachment is held in place by virtue of the elasticity of the strap pulling the edge of the hole up under the lip 50 of the hook.

Figure 6:
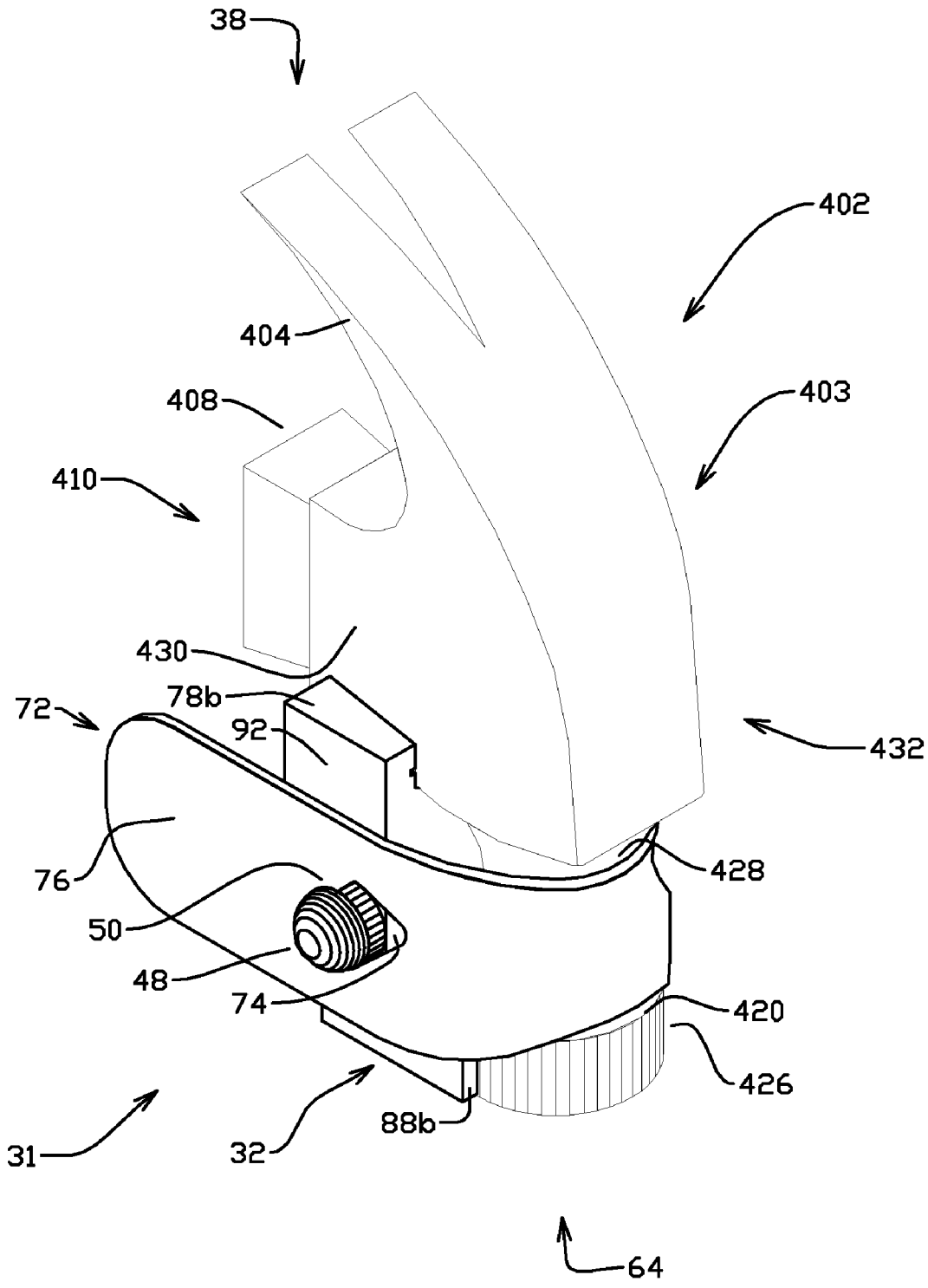
FIG. 6 shows the attachment attached to a prior art, conventional, nonmetal-handled claw hammer in perspective view from the back, upper, left-hand corner.

FIG. 6 shows essentially the same view as that of FIG. 4, except that the attachment 31 has been attached to the prior art hammer 402. The attaching strap 72 can be seen over the throat 428 and under the lip 50.

Figure 7A:
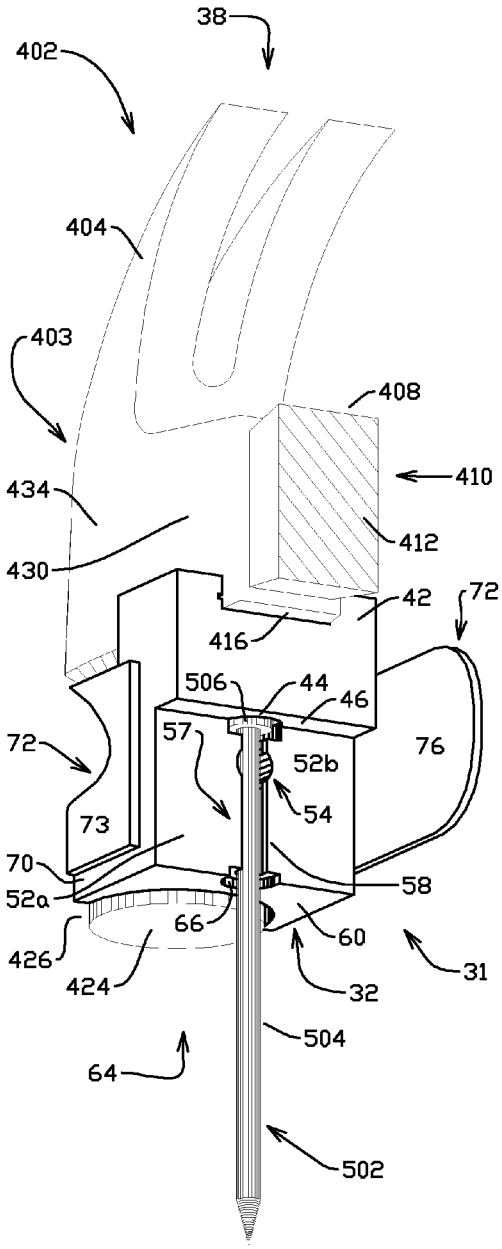
FIG. 7A shows the attachment attached to a prior art, conventional, nonmetal-handled claw hammer in perspective view from the front, lower, left-hand corner, with a prior art, 16d common, nail-type fastener inserted.

FIG. 7A shows essentially the same view as that of FIG. 5, except that a large, prior art, 16d common, nail-type fastener 502 is inserted into the fastener-receiving slot 58. The head 506 of the fastener is fitted up against the top of the fastener-head pocket 44. The fastener is held in place by the attraction between the magnet 56 and the fastener shank 504.

Figure 7B:
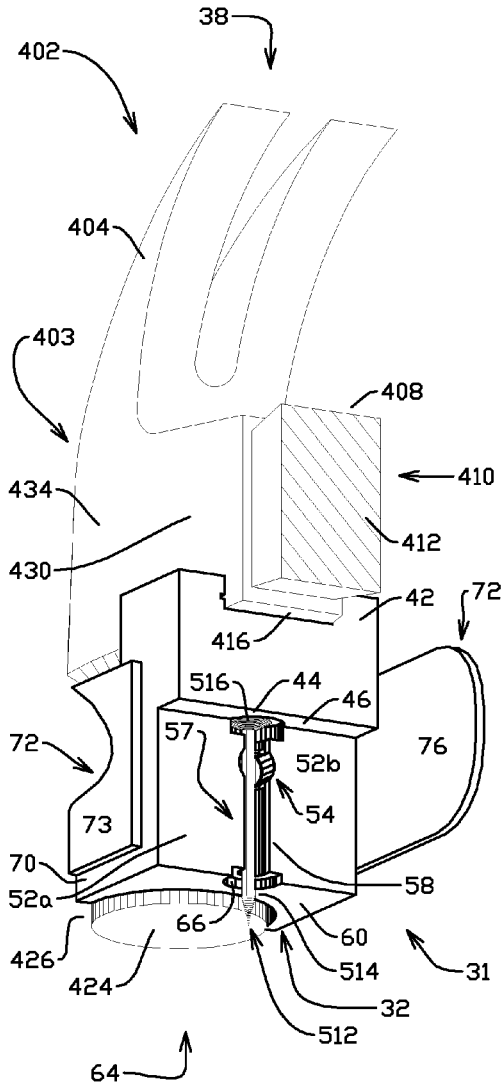
FIG. 7B shows the attachment attached to a prior art, conventional, nonmetal-handled claw hammer in perspective view from the front, lower, left-hand corner, with a prior art, 1½" drywall, nail-type fastener inserted.

FIG. 7B shows essentially the same view as that of FIG. 7A, except that in place of the 16d common, nail-type fastener, is a prior art, 1½" drywall, nail-type fastener 512. The head 516 of the fastener is fitted up against the top of the fastener-head pocket 44. The fastener is held in place by the attraction between the magnet 56 and the fastener shank 514.

Figure 8A:
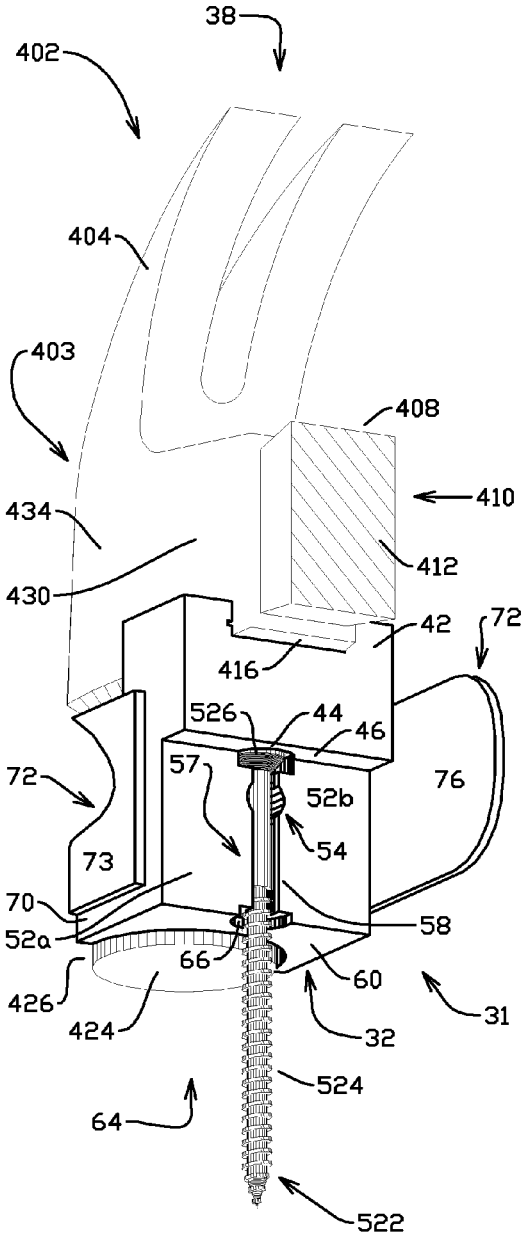
FIG. 8A shows the attachment attached to a prior art, conventional, nonmetal-handled claw hammer in perspective view from the front, lower, left-hand corner, with a prior art, #10 3" flat wood, screw-type fastener inserted.

FIG. 8A shows essentially the same view as that of FIG. 7A, except that in place of the 16d common, nail-type fastener, is a prior art, #10 3" flat wood, screw-type fastener 522. The head 526 of the fastener is fitted up against the top of the fastener-head pocket 44. The fastener is held in place by the attraction between the magnet 56 and the fastener shank 524.

Figure 8B:
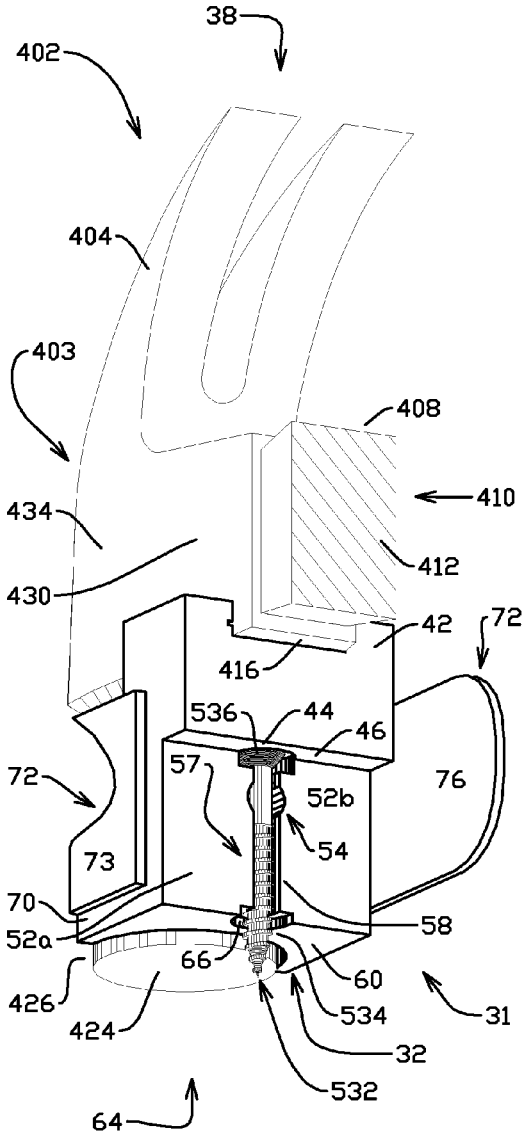
FIG. 8B shows the attachment attached to a prior art, conventional, nonmetal-handled claw hammer in perspective view from the front, lower, left-hand corner, with a prior art, #10 1½" flat wood, screw-type fastener inserted.

FIG. 8B shows essentially the same view as that of FIG. 8A, except that in place of the #10 3" flat wood, screw-type fastener, is a prior art, #10 1½" flat wood, screw-type fastener 532. The head 536 of the fastener is fitted up against the top of the fastener-head pocket 44. The fastener is held in place by the attraction between the magnet 56 and the fastener shank 534.

Figure 9A:
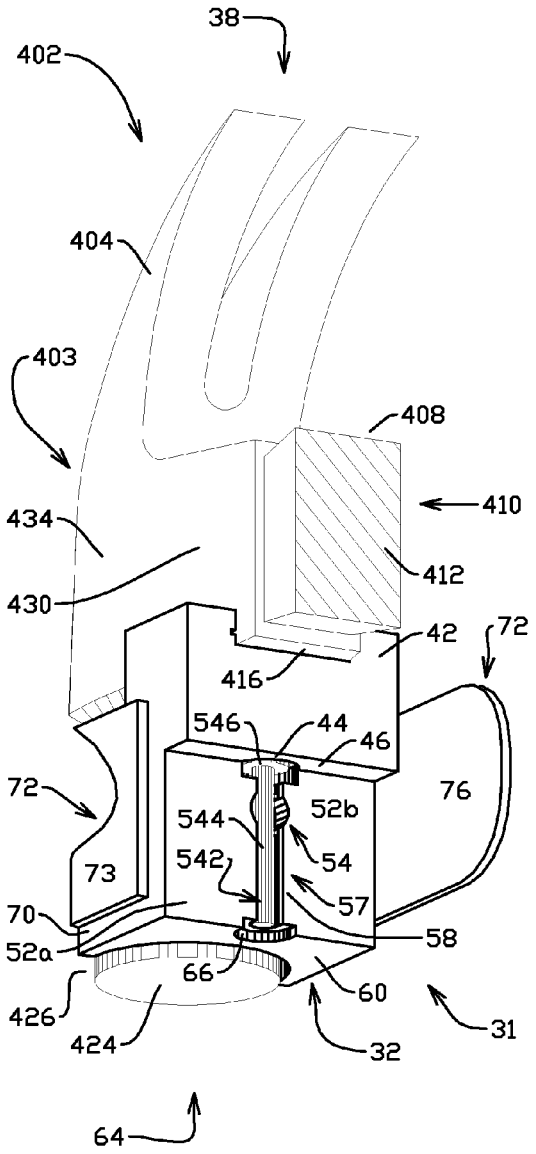
FIG. 9A shows the attachment attached to a prior art, conventional, nonmetal-handled claw hammer in perspective view from the front, lower, left-hand corner, with a prior art, cut-off 16d sinker, nail-type fastener-extender inserted.

FIG. 9A shows essentially the same view as that of FIG. 8A, except that in place of the #10 3" flat wood, screw-type fastener, is a prior art, cut-off 16d sinker, nail-type fastener, which serves as a magnetism and support extender 542. The head 546 of the magnetism and support extender is fitted up against the top of the fastener-head pocket 44. The extender is held in place by the attraction between the magnet 56 and the extender shank 544. The purpose of the fastener-extender, used in the preferred embodiment, is to transfer, or extend, the force of the magnet's magnetism, and to essentially extend the support of the top of the fastener-head pocket, to the slot mouth 66. The extender could be supplied with the attachment or could be easily made by the user. The extender is made by cutting off the pointed end of a prior art, 16d sinker, nail-type fastener. The cut is made such that the cut-off end is flush with the lower end of the fastener-receiving slot 58. The extender allows the attachment to accommodate fasteners that are not long enough to extend sufficiently beyond the striking face 424 of the hammer to allow the effective starting of the fastener in a work piece. While the extender is described here as a cut-off, prior art, 16d sinker, nail-type fastener, it could be any magnetic material that would serve the same purpose.

Figure 9B:
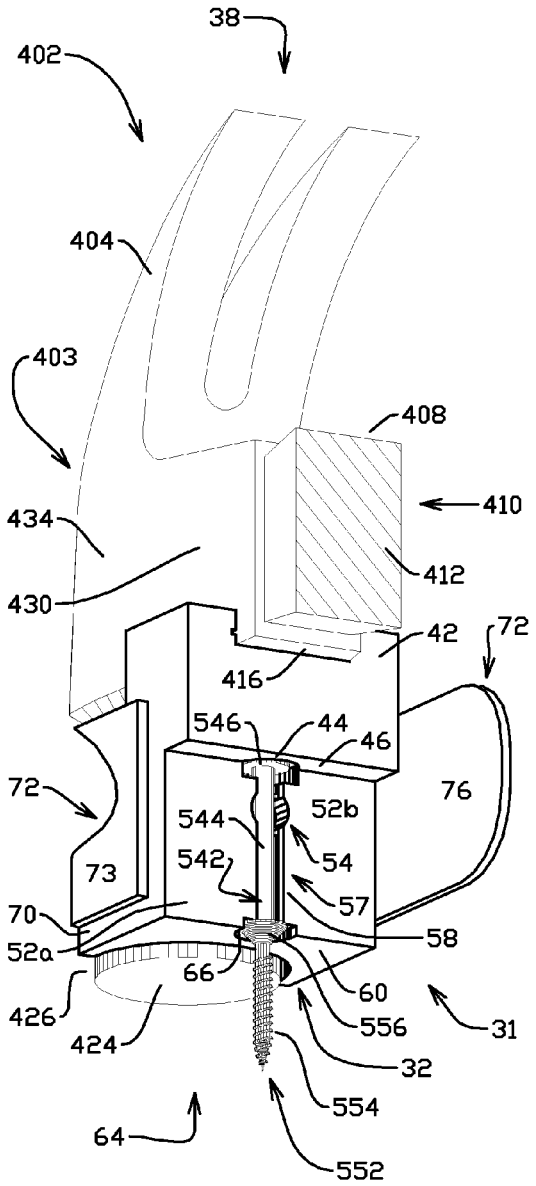
FIG. 9B shows the attachment attached to a prior art, conventional, nonmetal-handled claw hammer in perspective view from the front, lower, left-hand corner, with a prior art, cut-off 16d sinker, nail-type fastener-extender and a prior art, #6 fine drywall, screw-type fastener inserted.

FIG. 9B shows essentially the same view as that of FIG. 9A, except that in addition, a prior art, #6 fine drywall, screw-type fastener 552 is also shown. The head 556 of the fastener is seated against the upper edge of the slot mouth 66 and the cut-off end of the fastener-extender 542. The fastener is held in place by the extension of the magnetism through the extender. This allows the fastener shank 554 to extend far enough beyond the striking face 424 so that the fastener can be effectively started in a work piece.

Figure 10A:
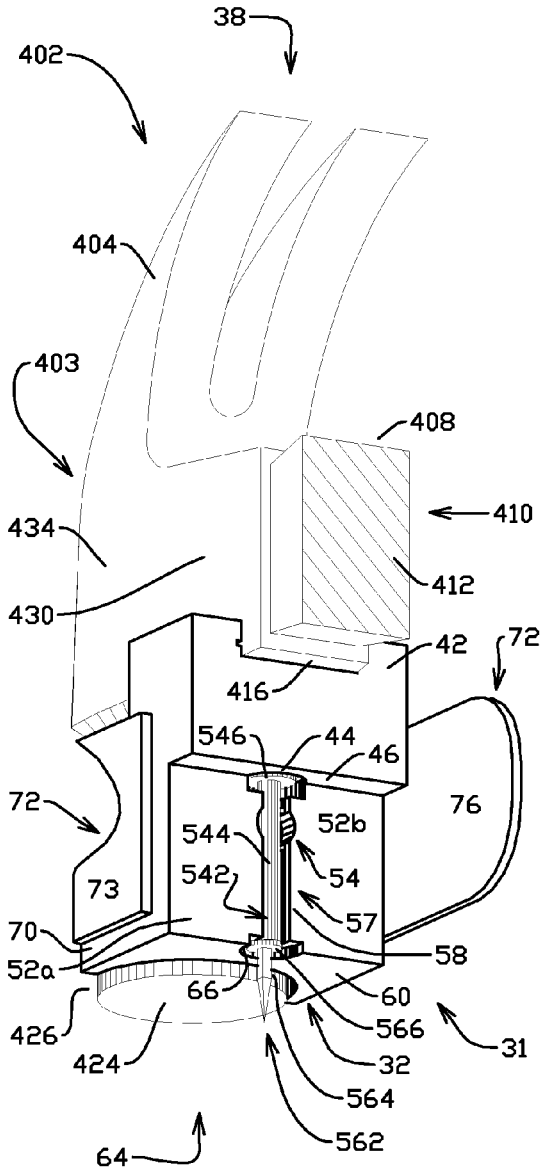
FIG. 10A shows the attachment attached to a prior art, conventional, nonmetal-handled claw hammer in perspective view from the front, lower, left-hand corner, with a prior art, cut-off 16d sinker, nail-type fastener-extender and a prior art, #6 carpet/upholstery tack, nail-type fastener inserted.

FIG. 10A shows essentially the same view as that of FIG. 9B, except that in place of the #6 fine drywall, screw-type fastener, is a prior art, #6 carpet/upholstery tack, nail-type fastener 562. The head 566 of the fastener is seated against the upper edge of the slot mouth 66 and the cut-off end of the fastener-extender 542. The fastener is held in place by the extension of the magnetism through the extender. This allows the fastener shank 564 to extend far enough beyond the striking face 424 so that the fastener can be effectively started in a work piece.

Figure 10B:
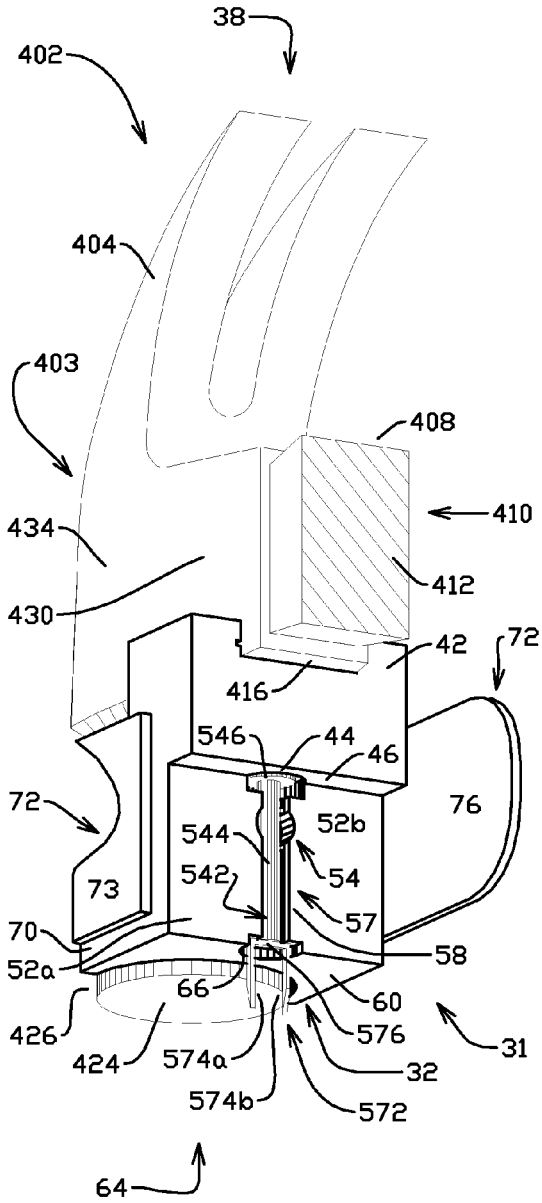
FIG. 10B shows the attachment attached to a prior art, conventional, nonmetal-handled claw hammer in perspective view from the front, lower, left-hand corner, with a prior art, cut-off 16d sinker, nail-type fastener-extender and a prior art, #5 wire cloth staple, nail-type fastener inserted.

FIG. 10B shows essentially the same view as that of FIG. 10A, except that in place of the #6 carpet/upholstery tack, is a prior art, #5 wire cloth staple, nail-type fastener 572. The head 576 of the fastener is seated against the upper edge of the slot mouth 66 and the cut-off end of the fastener-extender 542. The fastener is held in place by the extension of the magnetism through the extender. This allows the fastener shank 574*a* and 574*b* to extend far enough beyond the striking face 424 so that the fastener can be effectively started in a work piece.

FIGS. 11 through 13—Spacers to Accommodate FIGS. 2B-2D Hammers

Figure 11A:
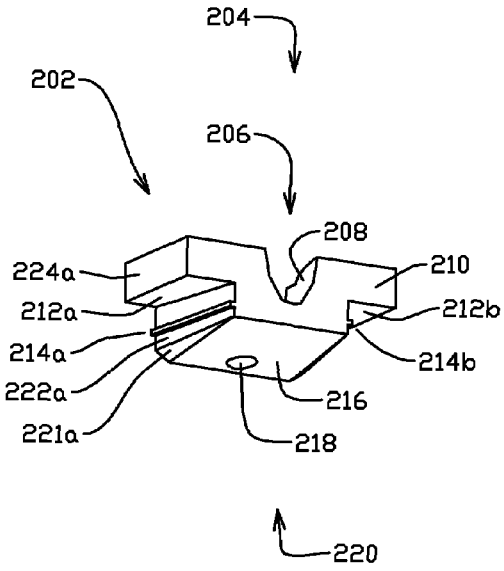
FIG. 11A shows an attachment spacer, to be used with a prior art, conventional, flat-handled hammer, in perspective view from the front, lower, left-hand corner.

FIG. 11A shows an attachment spacer 202, to be used with the attachment to accommodate a prior art, conventional, flat-handled hammer (402, FIG. 2B). In the preferred embodiment, the spacer is made of the same material and in the same manner as the attachment body. The spacer is made to slide into the sleeve/spacer receiving area 36 (FIG. 1) from the backside. The Fig is in perspective view from the front, lower, left-hand corner. The spacer has an upper portion 204 and a lower portion 220.

A hammer-handle cradle 206 is centered in the upper portion of the spacer. The cradle has a surface 208.

The spacer has a front face 210 and bottom, upper faces 212*a* and 212*b*. It has spacer-guiding ridges 214*a* and 214*b* on sides 222*a* and 222*b*. The width of the upper portion of the spacer is 1½ inches, the same width as the attachment body.

Figure 11B:
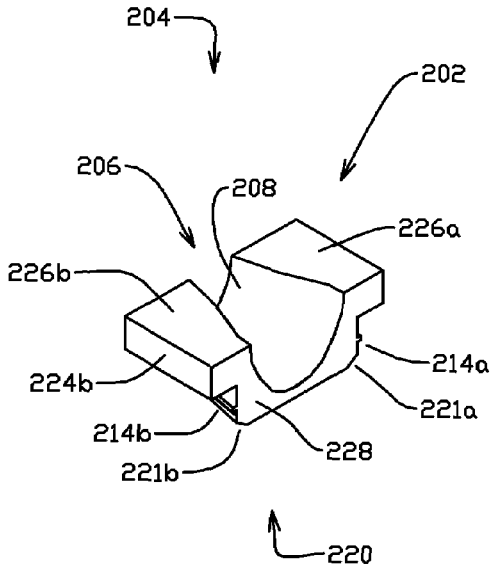
FIG. 11B shows this same spacer in perspective view from the back, upper, left-hand corner.

The bottom face 216 has a 3/16-inch diameter by 1/32-inch high bump 218 whose center is 5/32 inches from the back face (228, FIG. 11B). It is centered between the side edges of the face. The lower outside corners of the spacer have beveled edges 221*a* and 221*b*.

The spacer has an upper left side 224*a*. The side is ¼ inch high and 49/64 inch wide, the same dimension as the depth of the sleeve/spacer receiving area.

The underside parts 212, 214, 216, 218, 221, and 222, are mirror reflections of the inside of the sleeve/spacer receiving area. The bump 218 snaps into the receiving-area dimple 82 (FIG. 1) when the spacer is slid into receiving area.

The upper width of the opening of the hammer-handle cradle 206 on the front face 210 is ⅜ inch. On this same face, the opening converges slightly moving from the upper edge downward such that the opening is 5/16 inch at 11/64 inch down from the upper edge. The opening converges further going 9/64 inch downward from this point so that the width is 9/64 inch. The sides forming this section are arcs having radii of 57/64 inch. The lower ends of these arcs are coincident with the outer ends of the arc-shaped bottom of the opening. This bottom arc has a radius of 11/64 inch.

FIG. 11B shows the same attachment spacer 202, to be used with the attachment to accommodate a prior art, conventional, flat-handled hammer (402, FIG. 2B), but in perspective view from the back, upper, left-hand corner. From this view the top face 226*a* and 226*b*, the back face 228 and the upper right side 224*b* can be seen. This upper right side has the same dimensions as the upper left side.

The upper width of the opening of the hammer-handle cradle 206 on the back face 228 is 13/16 inch. On this same face, the opening converges slightly moving from the upper edge downward such that the opening is 51/64 inch at 9/64 inch down from the upper edge. The opening converges further going 19/64 inch downward from this point so that the width is 7/16 inch. The sides forming this section are arcs having radii of 1 1/32 inch. The lower ends of these arcs are coincident with the outer ends of the arc-shaped bottom of the opening. This bottom arc has a radius of 11/32 inch.

The cradle opening on the top face converges slightly from the back towards the front such that the opening is 51/64 inch ⅛ inch from the back edge. From this point, the cradle opening on this face converges more abruptly so that at the front face the opening is the ⅜ inch discussed under FIG. 11A. The sides forming this section are arcs having radii of 2¼ inch, convex towards the cradle.

The cradle surface 208 smoothly connects all of the cradle edges and is formed by casting against the handle bottom 436 and the handle side 438 of a prior art, conventional, flat-handled hammer (402, FIG. 2B).

Figure 11C:
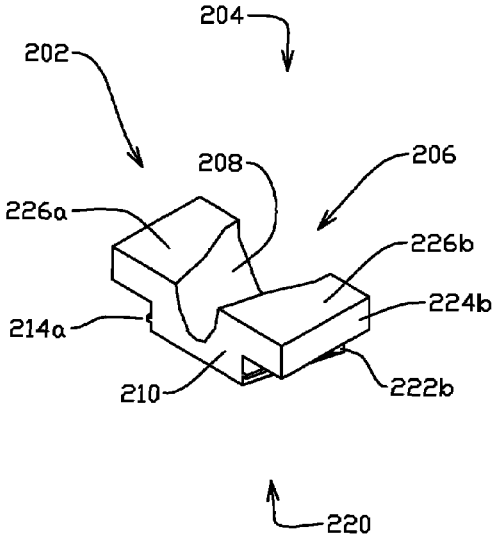
FIG. 11C shows this same spacer in perspective view from the front, upper, right-hand corner.
Figure 11D:
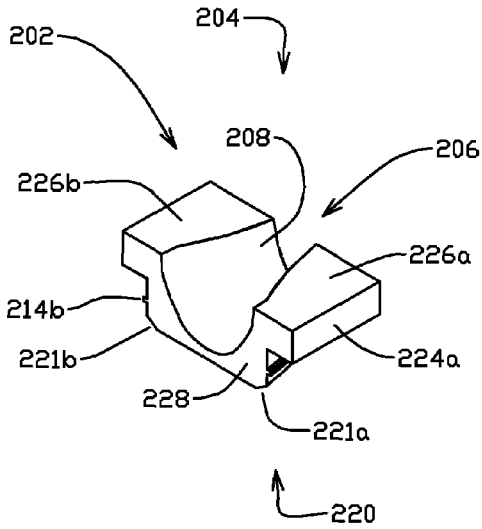
FIG. 11D shows this same spacer in perspective view from the back, upper, right-hand corner.

FIGS. 11C and 11D show this same attachment spacer in perspective views from the front, upper, right-hand corner and from the back, upper, right-hand corner, respectively.

Figure 12A:
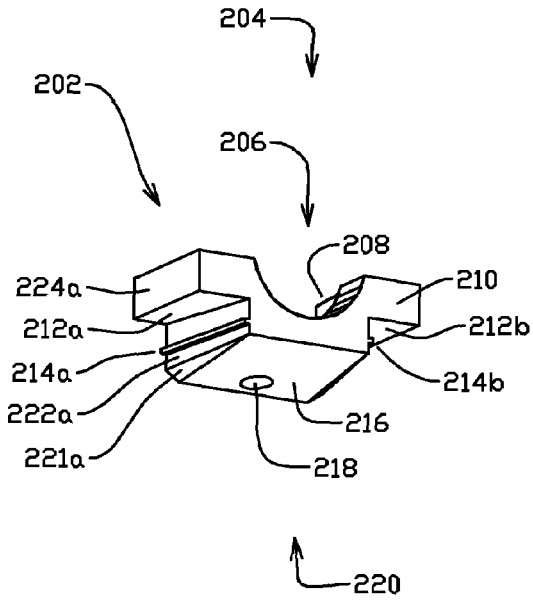
FIG. 12A shows an attachment spacer, to be used with a prior art, conventional, tubular-handled hammer, in perspective view from the front, lower, left-hand corner.

FIG. 12A shows a similar attachment spacer 202, but to be used with the attachment to accommodate a prior art, conventional, tubular-handled hammer (402, FIG. 2C). In the preferred embodiment, the spacer is made of the same material and in the same manner as the attachment body. The spacer is made to slide into the sleeve/spacer receiving area 36 (FIG. 1) from the backside. The Fig is in perspective view from the front, lower, left-hand corner. The spacer has an upper portion 204 and a lower portion 220.

A hammer-handle cradle 206 is centered in the upper portion of the spacer. The cradle has a surface 208.

The spacer has a front face 210 and bottom, upper faces 212*a* and 212*b*. It has spacer-guiding ridges 214*a* and 214*b* on sides 222*a* and 222*b*. The width of the upper portion of the spacer is 1½ inches, the same width as the attachment.

Figure 12B:
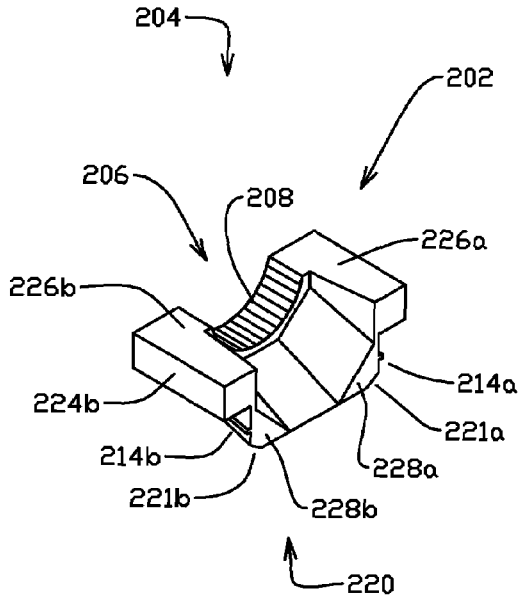
FIG. 12B shows this same spacer in perspective view from the back, upper, left-hand corner.

The bottom face 216 has a 3/16-inch diameter by 1/32-inch high bump 218 whose center is 5/32 inches from the back face (228, FIG. 12B). It is centered between the side edges of the face. The lower outside corners of the spacer have beveled edges 221*a* and 221*b*.

The spacer has an upper left side 224*a*. The side is ¼ inch high and 49/64 inch wide, the same dimension as the depth of the sleeve/spacer receiving area.

The underside parts 212, 214, 216, 218, 221, and 222, are mirror reflections of the inside of the sleeve/spacer receiving area. The bump 218 snaps into the receiving-area dimple 82 (FIG. 1) when the spacer is slid into receiving area.

The opening of the hammer-handle cradle 206 on the front face 210 is in the shape of a vertical, 49/128-inch radius arc with a chord length of about ¾ inch.

FIG. 12B shows the same above spacer 202, but in perspective view from the back, upper, left-hand corner. From this view the top face 226*a* and 226*b*, the back face 228 and the upper right side 224*b* can be seen. This upper right side has the same dimensions as the upper left side.

The opening of the hammer-handle cradle 206 on the back face 228 has approximately the following dimensions: The upper width of the opening is 63/64 inch. On this same face, this same width extends downward for 19/64 inch from the upper edge. The opening converges along two equal-length lines that intersect the lower edge of the back face creating an opening width along this edge of 13/32 inch.

The cradle opening on the top face 226 has approximately the following dimensions: The opening converges along two equal-length lines from the back face 228 towards the front such that the opening is ⅞ inch 31/64 inch from the back edge. From this point, the cradle opening reduces in width along two equal-length lines parallel to the front and back faces such that the opening is about ¾ inch, equal to that at the front face. This width is maintained along two 9/32-inch long lines to the intersection with the front face 210.

The back, upper sides of the cradle surface 208 form two vertical trapezoids whose back legs and front legs are parallel and are 19/64 inch and 7/64 inch long, respectively.

The back, bottom plane of the cradle surface is also a trapezoid whose back and front legs are parallel are 13/32 inch and 23/64 inch long, respectively. This plane is inclined from its back to its front by approximately 7/32 inch and terminates in the same plane containing the front legs of the trapezoidal sides.

The remaining two lower, outer planes of the back part of the cradle surface are formed by joining the corresponding ends of the two vertical side trapezoids with those of the back, bottom trapezoid.

The final front part of the cradle surface is a curved face that is the result of extending the cradle's arc-shaped front opening perpendicular to the front face 9/32 inch.

Casting against the handle bottom 436 and the handle-head junction 440 of a prior art, conventional, tubular-handled hammer (402, FIG. 2C) forms the cradle surface.

Figure 12C:
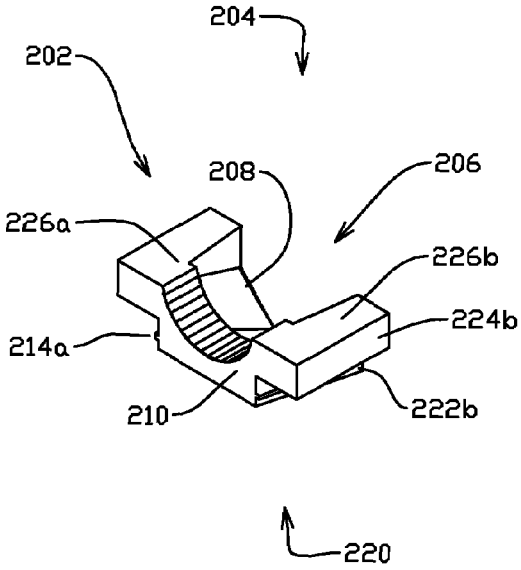
FIG. 12C shows this same spacer in perspective view from the front, upper, right-hand corner.
Figure 12D:
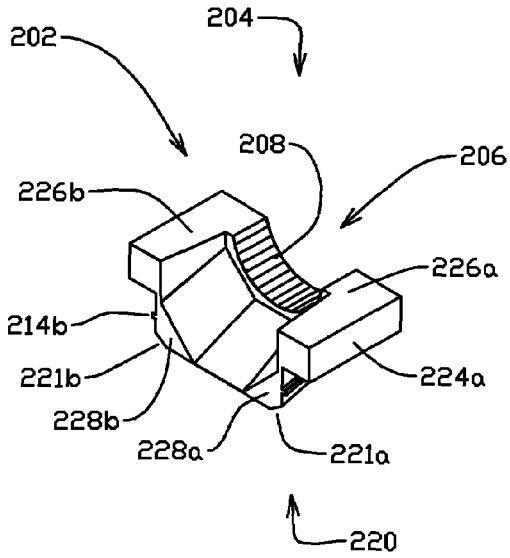
FIG. 12D shows this same spacer in perspective view from the back, upper, right-hand corner.

FIGS. 12C and 12D show this same attachment spacer in perspective views from the front, upper, right-hand corner and from the back, upper, right-hand corner, respectively.

Figure 13A:
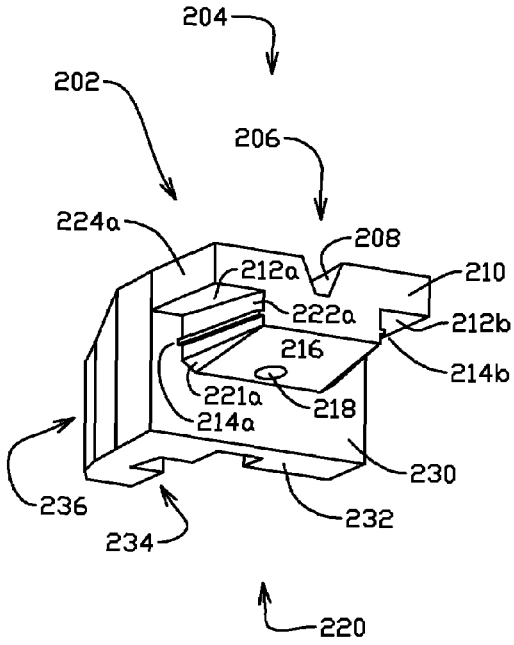
FIG. 13A shows an attachment spacer, to be used with a prior art, narrow-headed hammer, in perspective view from the front, lower, left-hand corner.

FIG. 13A shows a similar attachment spacer 202, but to be used with the attachment to accommodate a prior art, narrow-headed hammer (402, FIG. 2D). In the preferred embodiment, the spacer is made of the same material and in the same manner as the attachment body. The spacer is made to slide into the sleeve/spacer receiving area 36 (FIG. 1) from the backside. The Fig is in perspective view from the front, lower, left-hand corner. The spacer has an upper portion 204 and a lower portion 220.

A hammer-handle cradle 206 is centered in the upper portion of the spacer. The cradle has a surface 208.

The spacer has a front face 210 and bottom, upper faces 212*a* and 212*b*. It has spacer-guiding ridges 214*a* and 214*b* on sides 222*a* and 222*b*. The width of the upper, front portion of the spacer is 1½ inches, the same width as the attachment.

The upper, bottom face 216 has a 3/16-inch diameter by 1/32-inch high bump 218 whose center is 5/32 inches from the back edge. It is centered between the side edges of the face. The lower outside corners of the spacer have beveled edges 221*a* and 221*b*.

The spacer has an upper, front left side 224*a*. The side is ¼ inch high and 49/64 inch wide, the same dimension as the depth of the sleeve/spacer receiving area.

The underside parts 212, 214, 216, 218, 221, and 222, are mirror reflections of the inside of the sleeve/spacer receiving area. The bump 218 snaps into the receiving-area dimple 82 (FIG. 1) when the spacer is slid into receiving area.

The opening of the hammer-handle cradle 206 on the front face 210 is in the shape of a truncated triangle with the upper, open base length being approximately 9/32 inch. The shorter, truncated side is approximately ⅛ inch. The height of the truncated triangle is approximately 17/64 inch.

The spacer has a lower, front face 230. This face has a width of 1½ inches. Its lower edge is ¾ inch down below the upper, lower face 212.

The spacer has a lower, bottom face 232, an arm 236, and a finger 234 at the end of this arm.

Figure 13B:
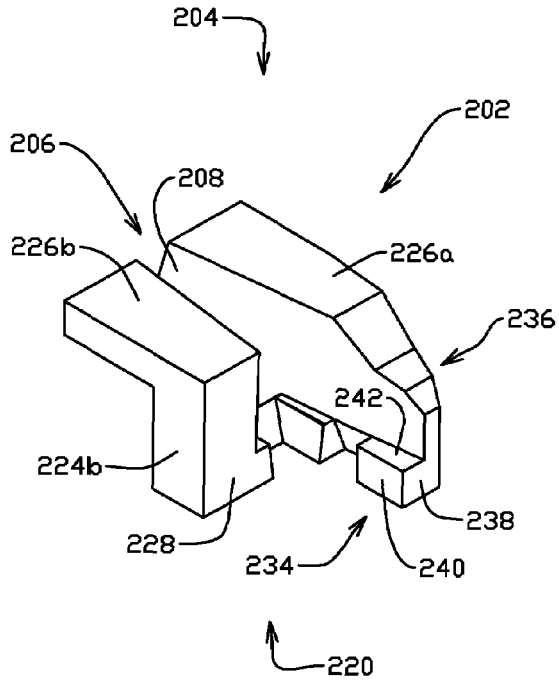
FIG. 13B shows this same spacer in perspective view from the back, upper, left-hand corner.

FIG. 13B shows the same above spacer 202, but in perspective view from the back, upper, left-hand corner. From this view the top face 226*a* and 226*b*, the back face 228 and the right side 224*b* can be seen. The upper, forward rectangular portion of this side has the same dimensions as the upper left side 224*a*. However, this right side has an additional rectangular portion that extends 7/16 inch towards the back and ¾ inch towards the bottom.

Also from this view can be seen the arm back face 238, and the side and upper faces of the finger, 240 and 242, respectively. The faces of the finger hook into the notch 442 in the hammer throat (FIG. 2D), to help hold the attachment in place.

Casting against the handle bottom 436, the handle side 438, the cheek 434, the neck 418, the throat 428, and the notch 442 of a prior art, narrow-headed hammer (402, FIG. 2D) forms the cradle and finger surfaces.

Figure 13C:
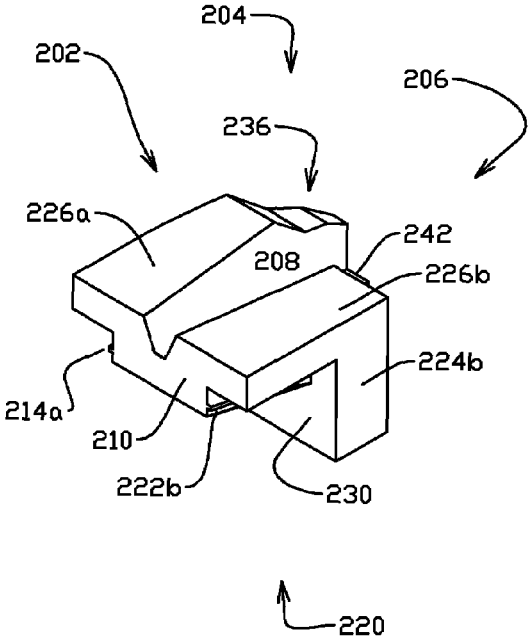
FIG. 13C shows this same spacer in perspective view from the front, upper, right-hand corner.
Figure 13D:
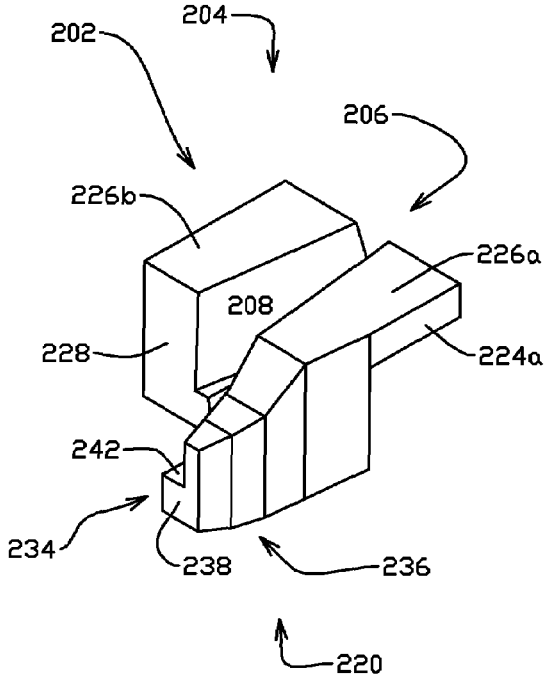
FIG. 13D shows this same spacer in perspective view from the back, upper, right-hand corner.

FIGS. 13C and 13D show this same attachment spacer in perspective views from the front, upper, right-hand corner and from the back, upper, right-hand corner, respectively.

FIGS. 14 through 16—Attachment Shown with FIGS. 2B-2D Hammers

Figure 14A:
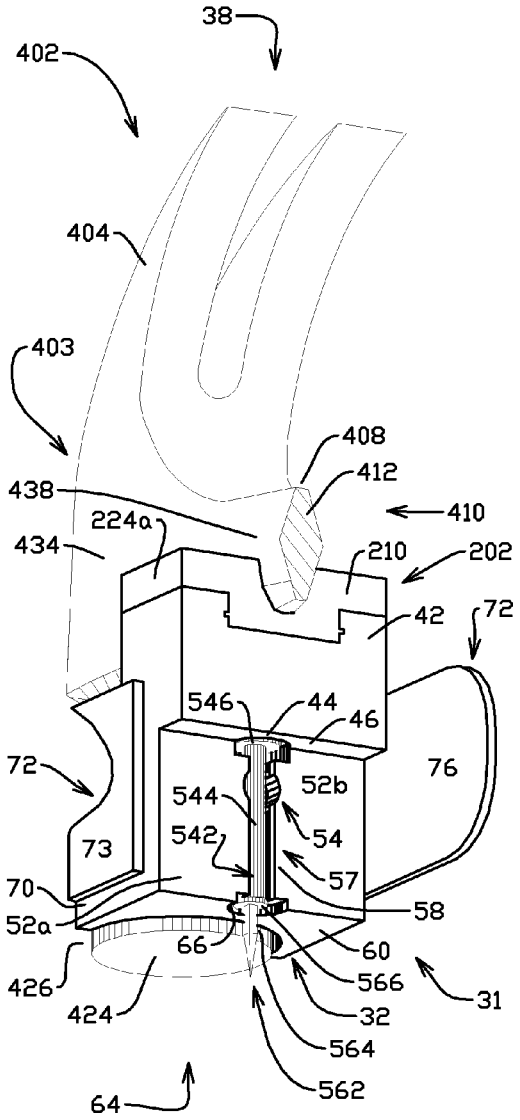
FIG. 14A shows the attachment, with FIG. 11 spacer, attached to a prior art, conventional, flat-handled hammer, in perspective view from the front, lower, left-hand corner, with a prior art, 16d common, nail-type fastener inserted.

FIG. 14A shows essentially the same view as that of FIG. 10A, except that the spacer 202 for a prior art flat-handled hammer (FIG. 11) has been inserted into the sleeve/spacer receiving area (36 FIG. 1) and the attachment has been attached to a prior art flat-handled hammer (402 FIG. 2B).

Figure 14B:
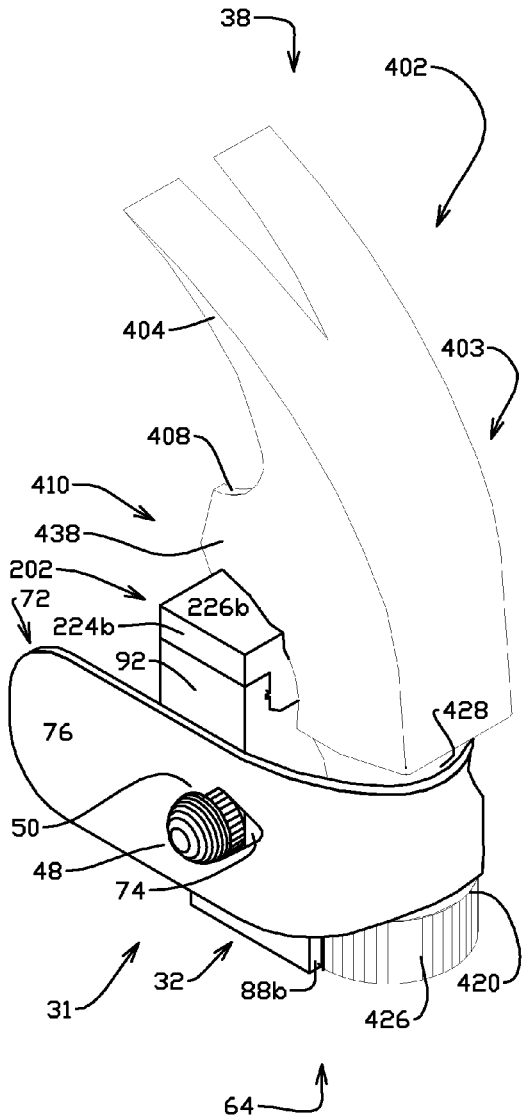
FIG. 14B shows the attachment, with FIG. 11 spacer, attached to a prior art, conventional, flat-handled hammer in perspective view from the back, upper, left-hand corner.

FIG. 14B shows the same setup, but in perspective view from the back, upper, left-hand corner.

Figure 15A:
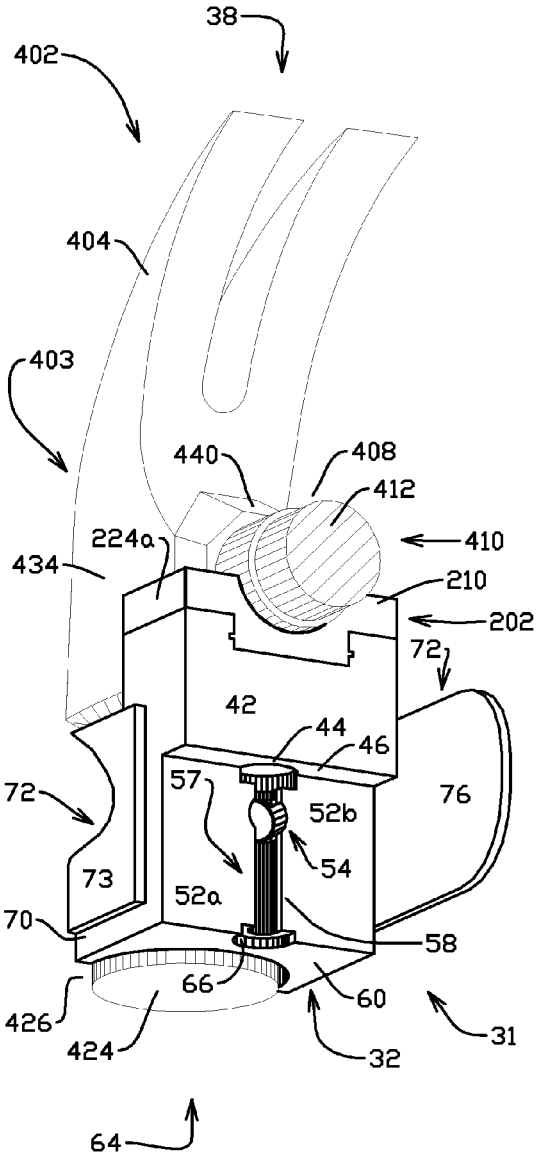
FIG. 15A shows the attachment, with FIG. 12 spacer, attached to a prior art, conventional, tubular-handled hammer, in perspective view from the front, lower, left-hand corner.

FIG. 15A shows essentially the same view as that of FIG. 14A, except that the spacer 202 for a prior art tubular-handled hammer (FIG. 12) has been inserted into the sleeve/spacer receiving area (36 FIG. 1) and the attachment has been attached to a prior art tubular-handled hammer 402 (FIG. 2C), and the extender and fastener are not shown.

Figure 15B:
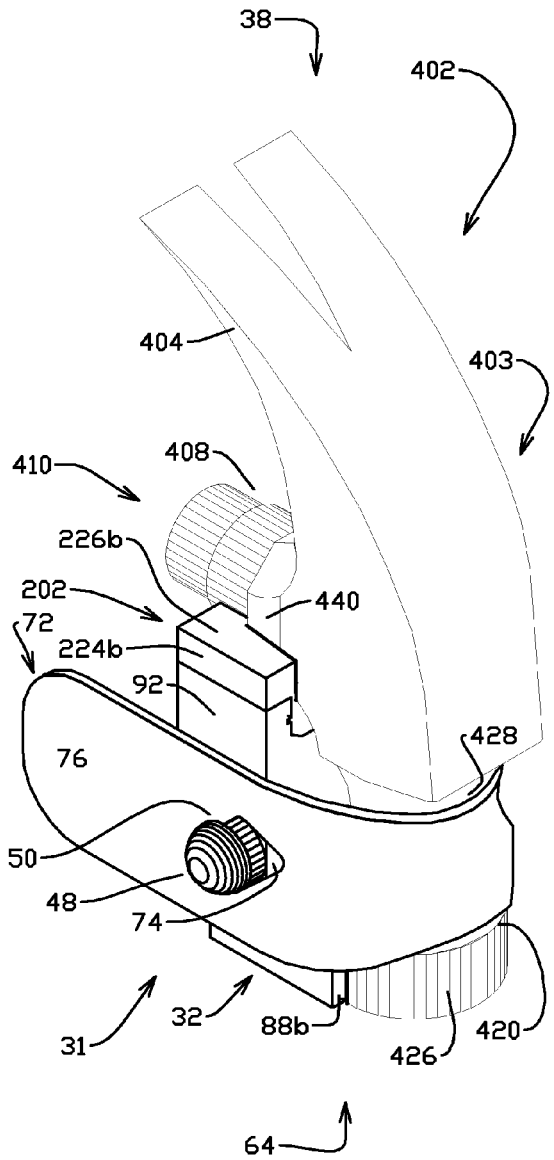
FIG. 15B shows the attachment, with FIG. 12 spacer, attached to a prior art, conventional, tubular-handled hammer in perspective view from the back, upper, left-hand corner.

FIG. 15B shows the same setup, but in perspective view from the back, upper, left-hand corner.

Figure 16A:
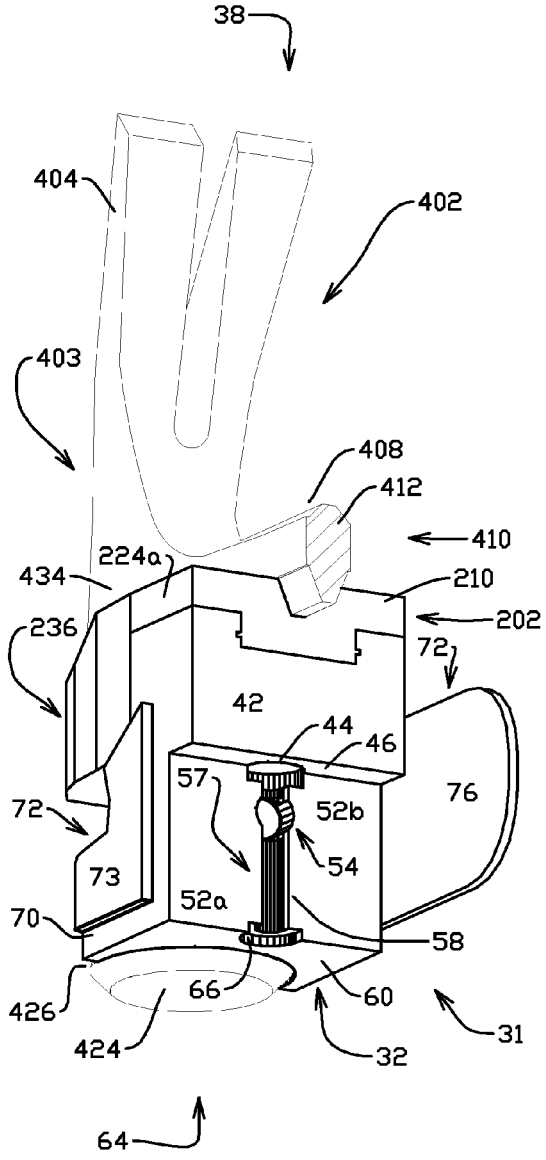
FIG. 16A shows the attachment, with FIG. 13 spacer, attached to a prior art, narrow-headed hammer, in perspective view from the front, lower, left-hand corner.

FIG. 16A shows essentially the same view as that of FIG. 15A, except that the spacer 202 for a prior art narrow-headed hammer (FIG. 13) has been inserted into the sleeve/spacer receiving area (36 FIG. 1) and the attachment has been attached to a prior art narrow-headed hammer 402 (FIG. 2D).

Figure 16B:
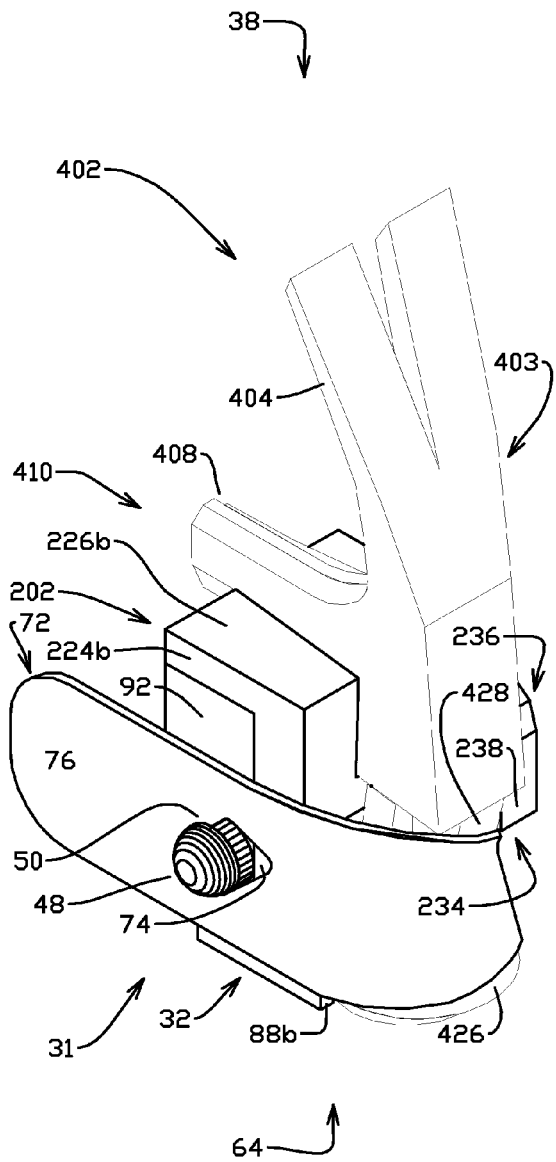
FIG. 16B shows the attachment, with FIG. 13 spacer, attached to a prior art, narrow-headed hammer in perspective view from the back, upper, left-hand corner.

FIG. 16B shows the same setup, but in perspective view from the back, upper, left-hand corner. From this view, the holding arm 236 can be seen extending around the side of the hammer and the holding finger 234 up against the hammer throat 428 where it extends into the throat notch (442, FIG. 2D).

Figure 17A:
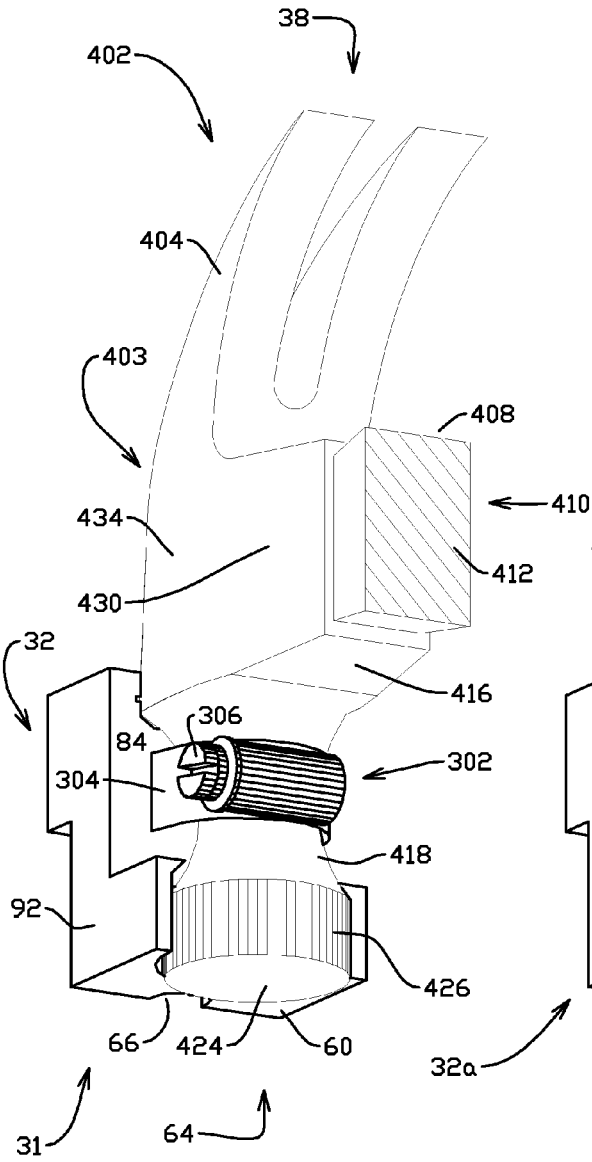
FIGS. 17A and 17B show two different means of attaching the attachment to a hammer.
Figure 17B:
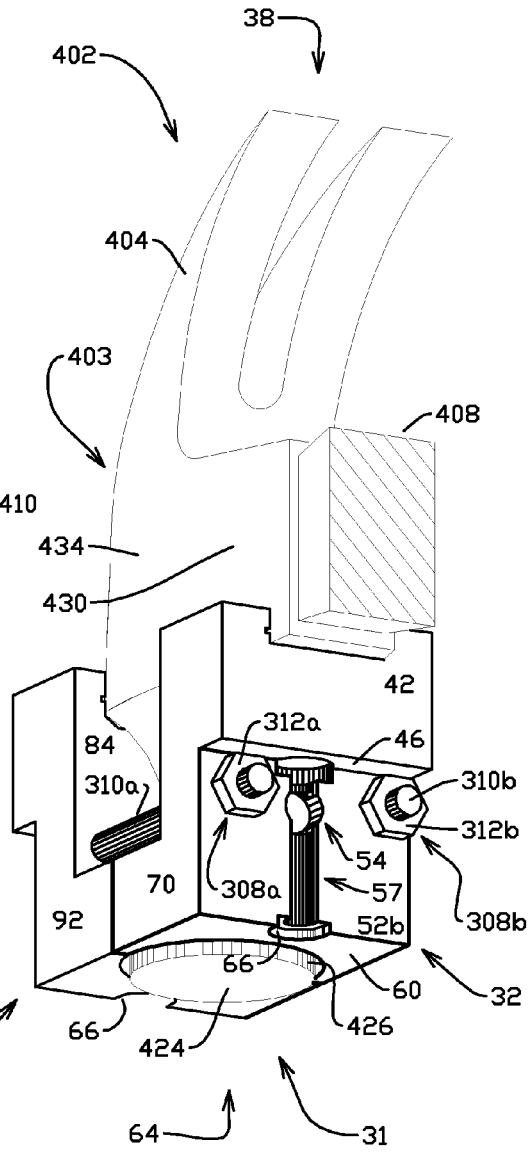

FIGS. 17A and 17B—Additional Embodiments—Other Means of Attachment

FIG. 17A shows an alternative means of attaching the attachment to a hammer. Alternative attaching screw-type strap clamp 302 is secured to the attachment body 32 by having its strap 304 embedded into the attachment body upper back face 84 during the casting of the body. The attachment is attached to a hammer by inserting the hammer between the face 84 and the strap 304 and then tightening the clamp via the screw 306.

FIG. 17B shows another alternative means of attaching the attachment to a hammer. Alternative attaching mechanism or connecting apparatus 308*a* and 308*b* attach the attachment body 32 to a hammer via bolts 310*a* and 310*b* through holes in the attachment body and an alternative additional attachment body or analogous attaching piece 32*a* and matching nuts 312*a* and 312*b*. The attachment is attached to a hammer by inserting the hammer between the faces 84 and then tightening the bolts.

FIGS. 18, 19, and 20—Alternative Embodiments—Fastener Holding Means

Figure 18A:
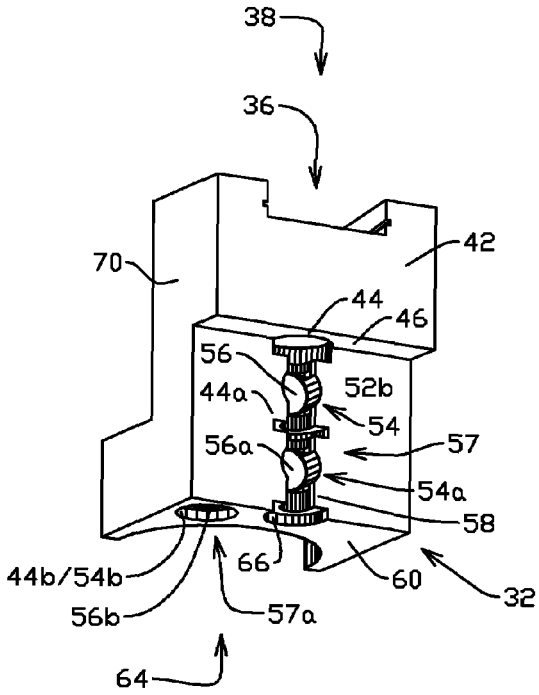
FIGS. 18 through 20 show different configurations for holding a fastener.

FIG. 18A shows an attachment body with alternative means of holding fasteners. The Fig shows two additional alternative fastener-head pockets 44*a* and 44*b*, two additional alternative fastener-holding apparatuses 54*a* and 54*b*, and two additional alternative magnets 56*a* and 56*b*.

Figure 18B:
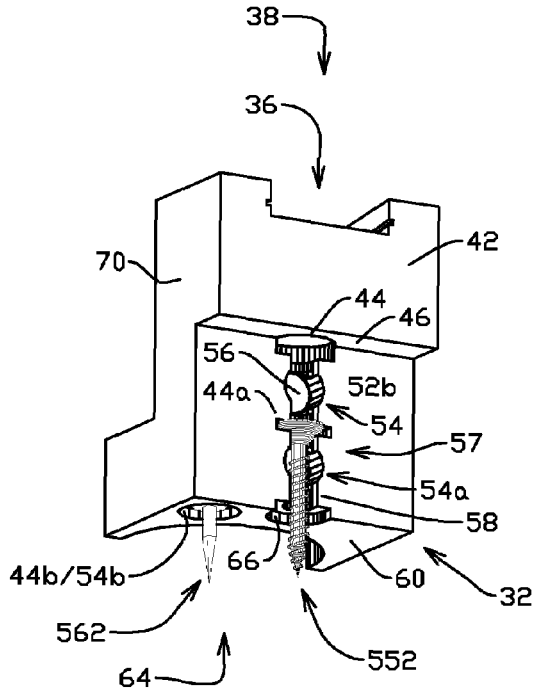

FIG. 18B is the same view as 18A, except that a prior art, #6 fine drywall, screw-type fastener 552 and a prior art, #6 carpet/upholstery tack, nail-type fastener 562 are also shown seated in the attachment body.

Figure 19A:
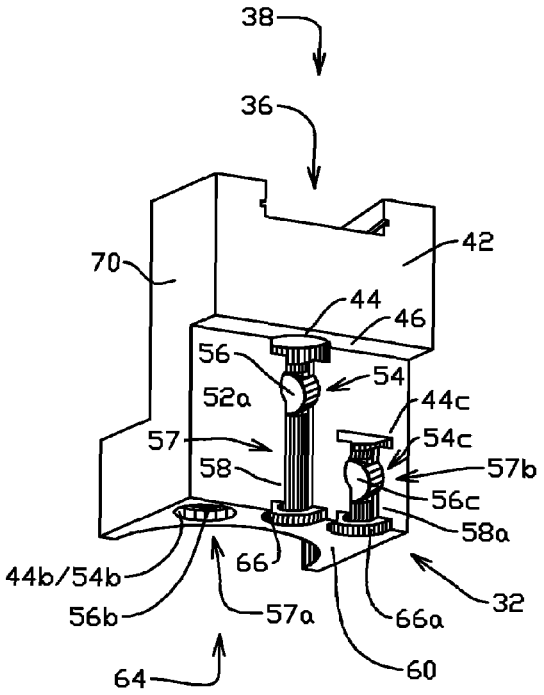

FIG. 19A shows an attachment body with another alternative means of holding fasteners. The Fig shows a third additional alternative fastener-head pocket 44*c*, a third additional alternative fastener-holding apparatus 54*c*, a third additional alternative magnet 56*c*, an additional alternative fastener-receiving region, groove, or slot 58*a*, and an additional alternative slot mouth 66*a*.

Figure 19B:
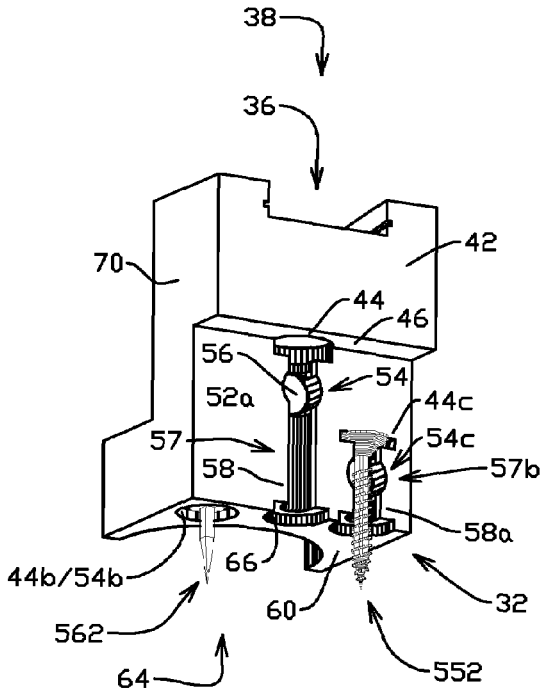

FIG. 19B is the same view as 19A, except that a prior art, #6 fine drywall, screw-type fastener 552 and a prior art, #6 carpet/upholstery tack, nail-type fastener 562 are also shown seated in the attachment body.

Figure 20A:
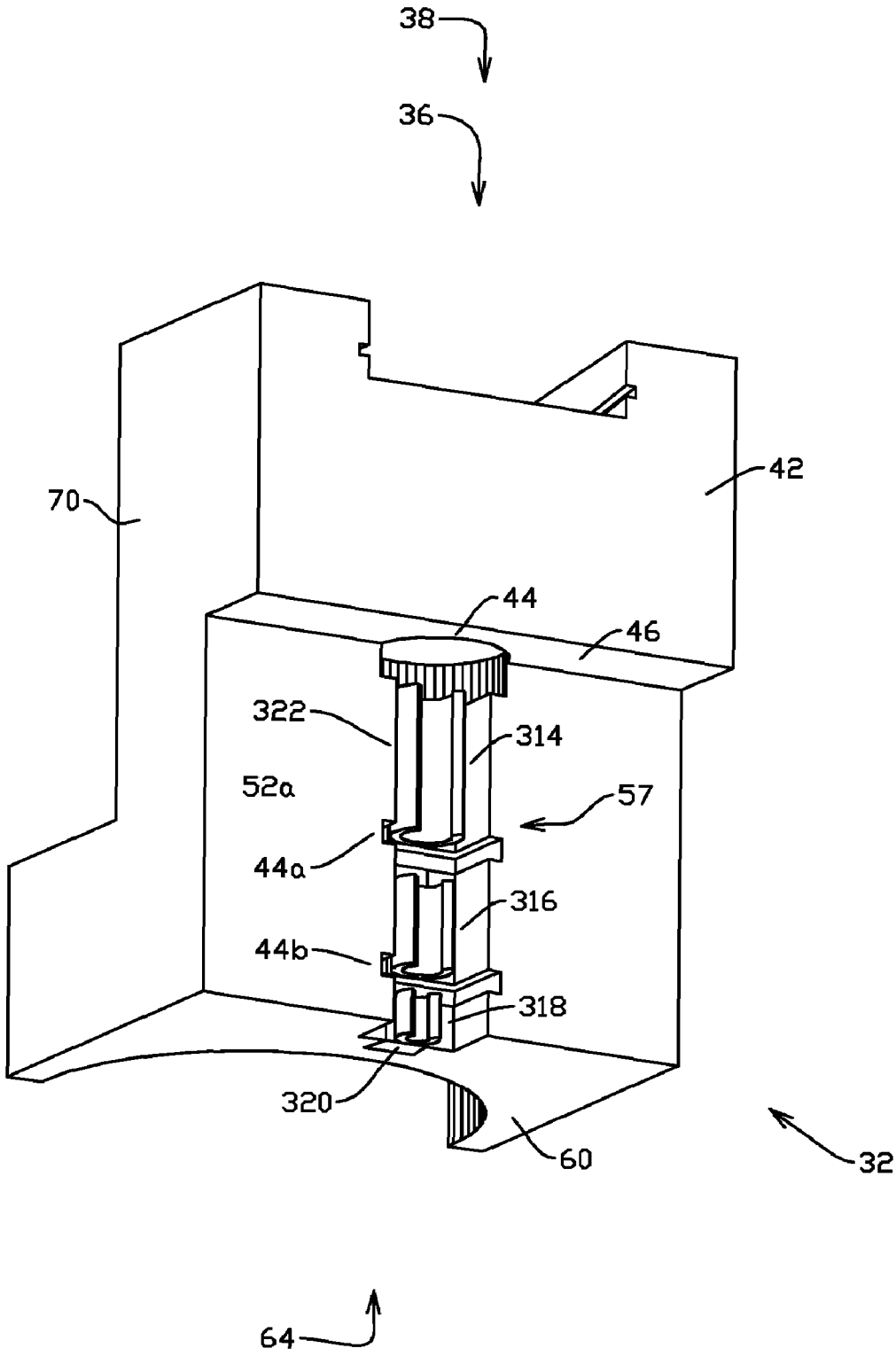

FIG. 20A shows an attachment body with another alternative means of holding fasteners. The Fig shows an alternative large-fastener flexible holding fingers insert 314, an alternative medium-fastener flexible holding fingers insert 316, and an alternative small-fastener flexible holding fingers insert 318. It also shows an alternative insert notch 320, an alternative inserts-receiving opening 322, and two additional alternative fastener-head pockets 44*a* and 44*b*. The flexible fingers are made out of a rubber or flexible plastic-like material and are inserted into the insert notch that is formed into the casting of the attachment body. The insert notch is centered along the back of the inserts-receiving opening. The holding fingers hold fasteners of different type, size, and shape without the use of magnetism and therefore can hold non-magnetic fasteners.

Figure 20B:
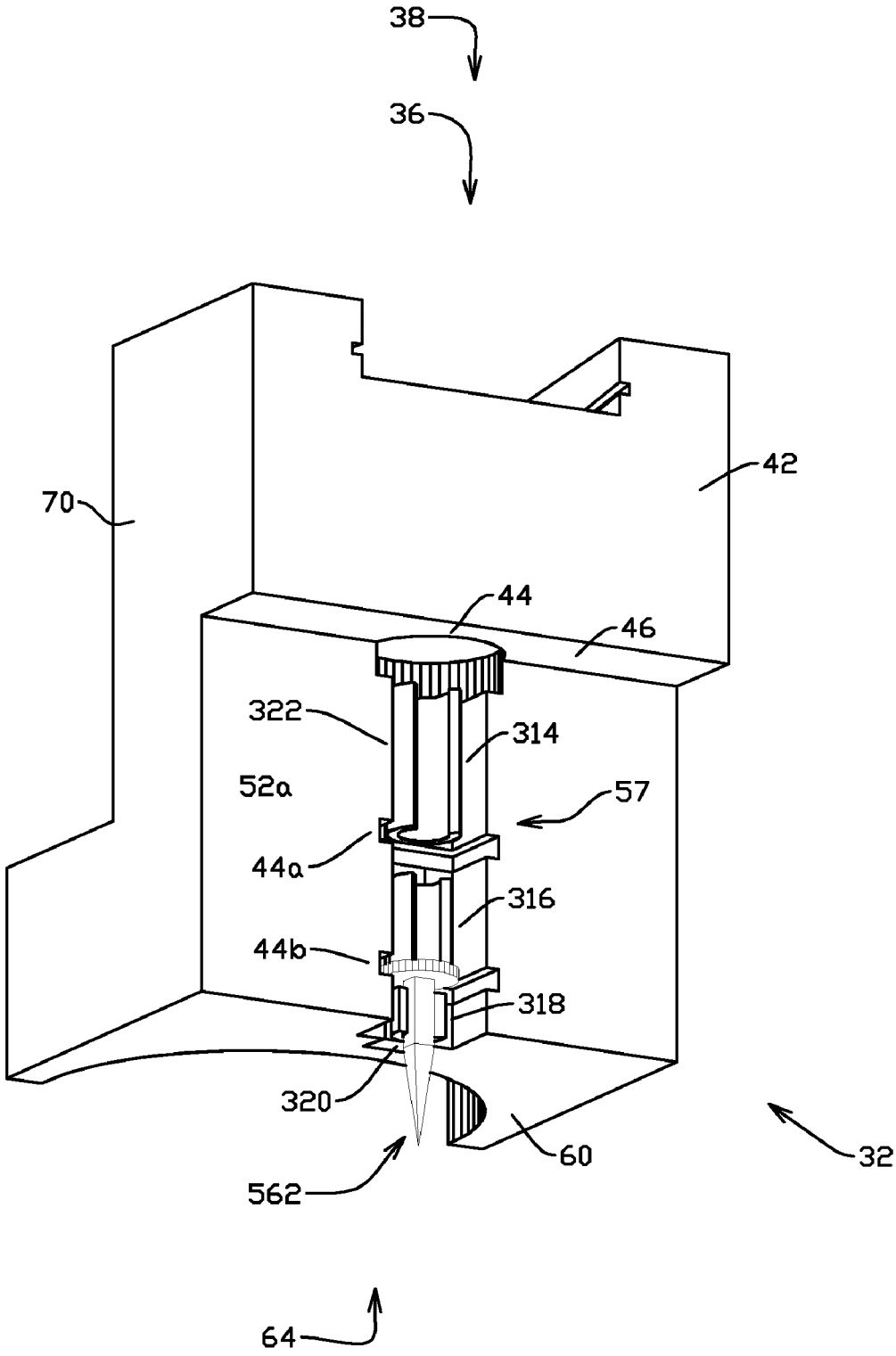

FIG. 20B is the same view as 20A, except that a prior art, #6 carpet/upholstery tack, nail-type fastener 562 is also shown being held by the small-fastener flexible holding fingers insert 318 and seated against the upper face of the fastener-head pocket 44*b*.

Figure 20C:
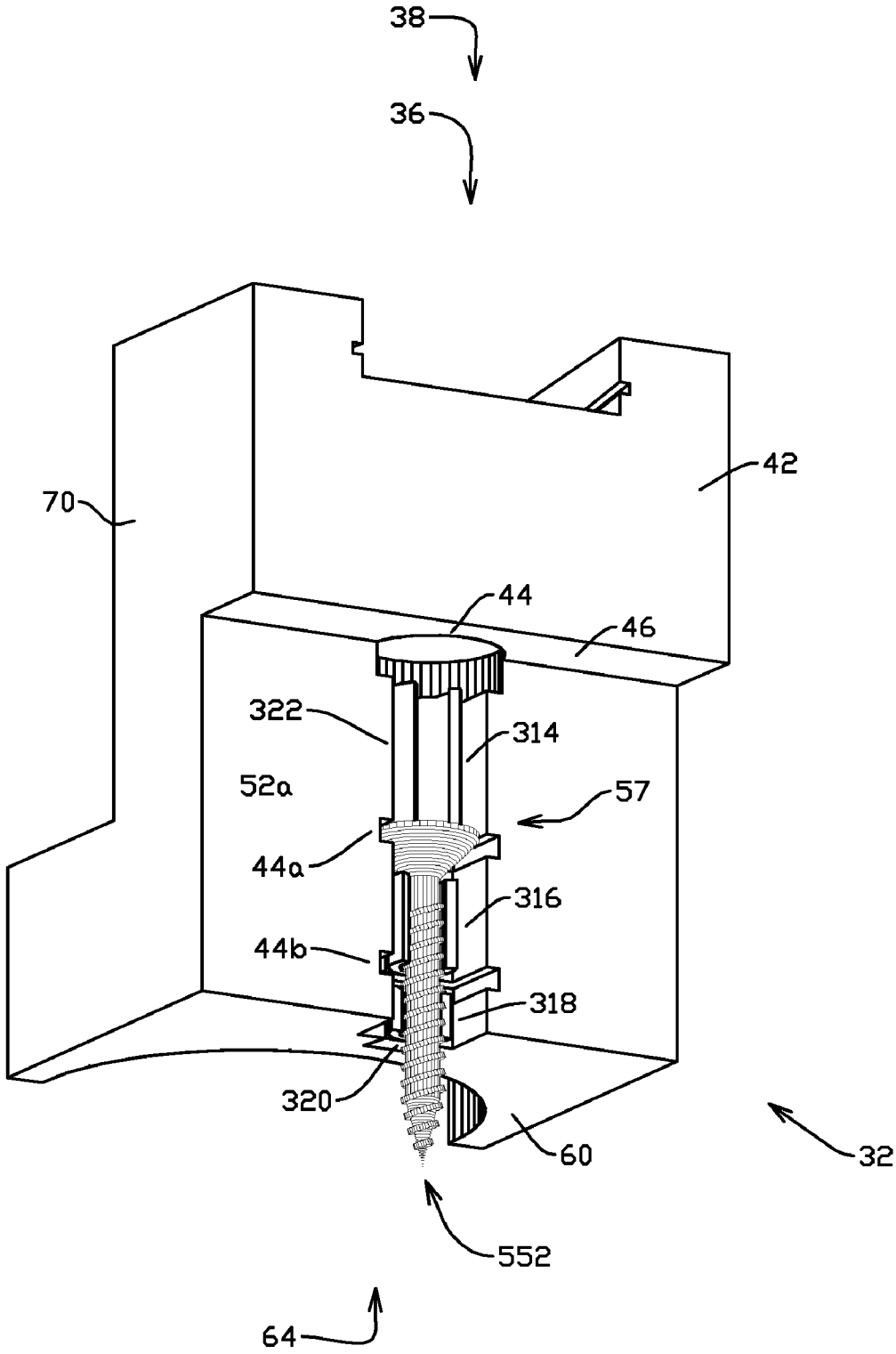

FIG. 20C is the same view as 20A, except that a prior art, #6 fine drywall, screw-type fastener 552 is also shown being held by the medium-fastener flexible holding fingers insert 316 and seated against the upper face of the fastener-head pocket 44*a*.

Figure 20D:
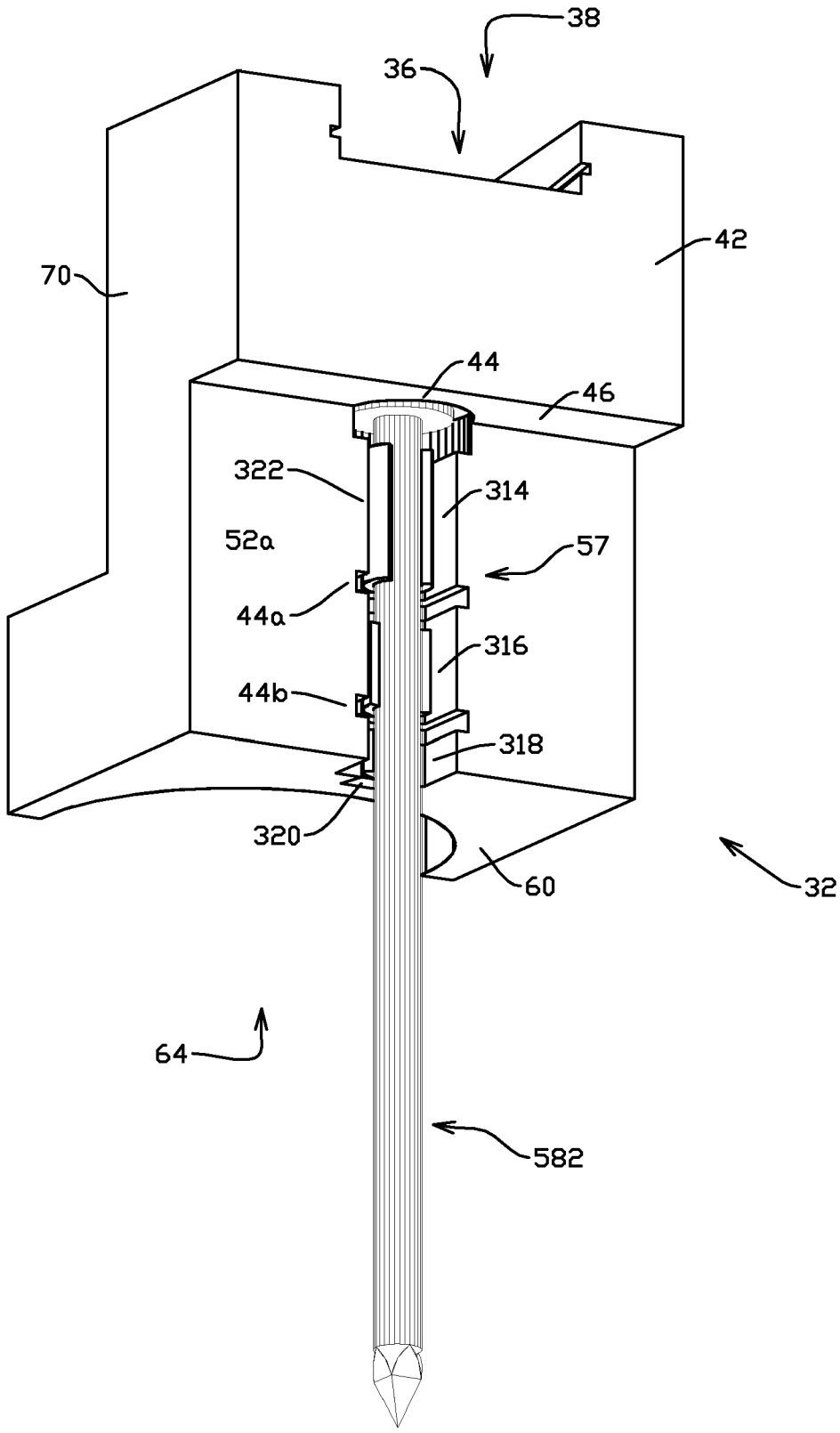

FIG. 20D is the same view as 20A, except that a prior art, 10d box, nail-type fastener 582 is also shown being held by the large-fastener flexible holding fingers insert 314 and seated against the upper face of the fastener-head pocket 44.

Figure 21A:
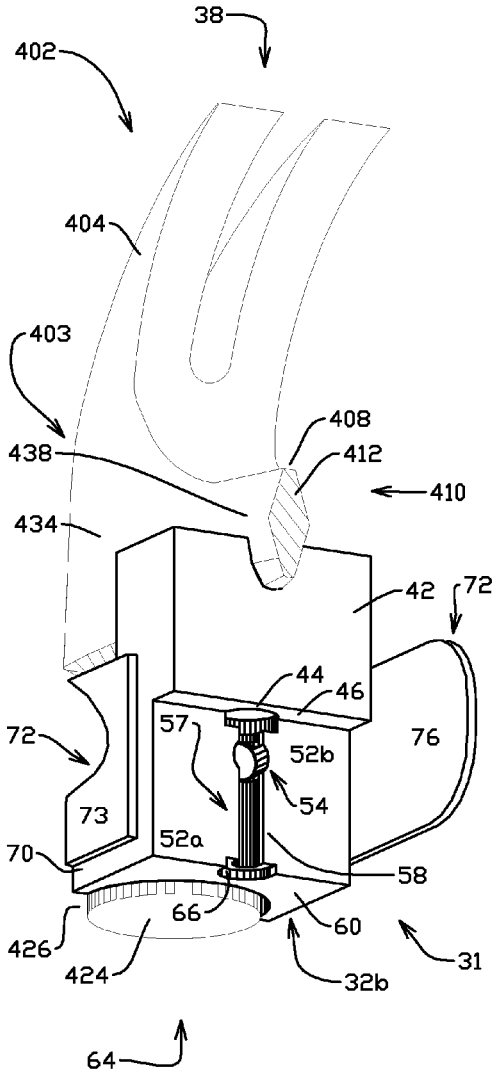
FIGS. 21A and 21B show the attachment, in perspective view from the front, lower, left-hand corner, and from the back, upper, left-hand corner, respectively, attached to a prior art, conventional, flat-handled hammer, with the attachment made to specifically fit the flat-handled hammer.
Figure 21B:
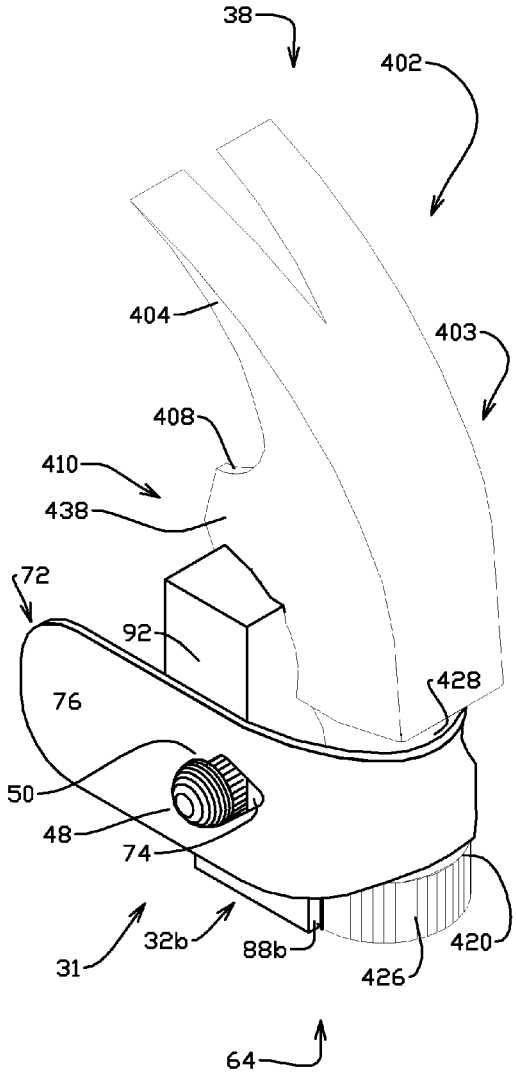

FIGS. 21,22, and 23—Alternative Embodiments—Hammer-Specific Attachments FIGS. 21A and 21B show essentially the same views as FIGS. 14A and 14B, except that the attachment is made in this case to specifically fit the flat-handled hammer, eliminating the need for the spacer, and no fastener is shown.

Figure 22A:
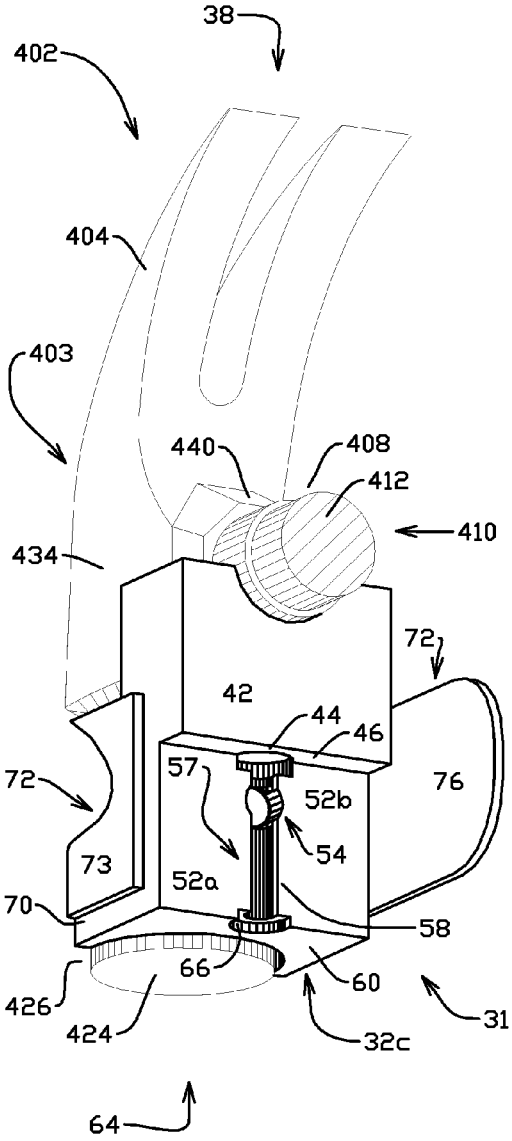
FIGS. 22A and 22B show the attachment, in perspective view from the front, lower, left-hand corner, and from the back, upper, left-hand corner, respectively, attached to a prior art, conventional, tubular-handled hammer, with the attachment made to specifically fit the tubular-handled hammer.
Figure 22B:
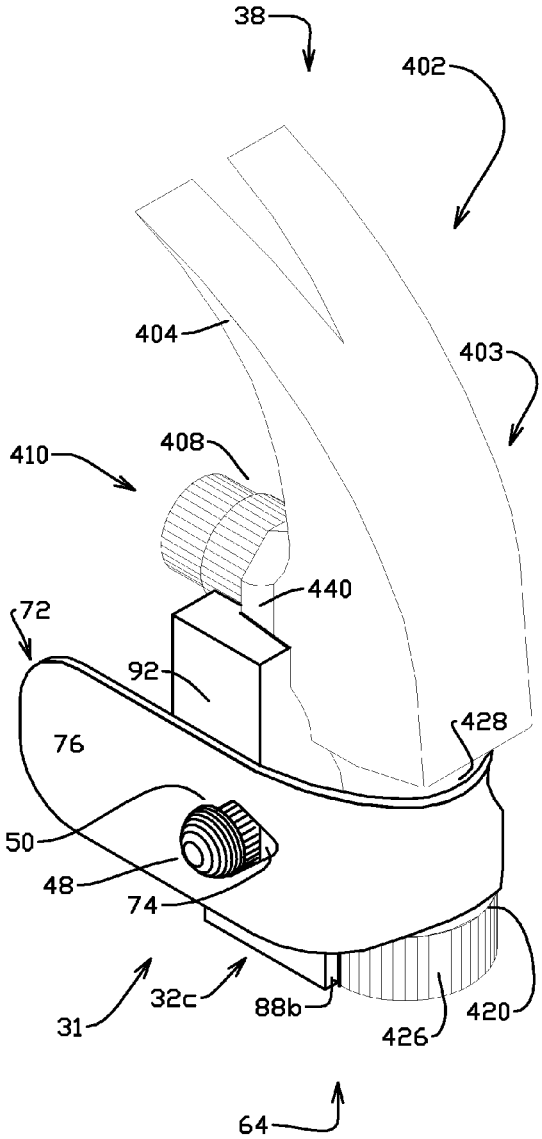

FIGS. 22A and 22B show essentially the same views as FIGS. 15A and 15B, except that the attachment is made in this case to specifically fit the tubular-handled hammer, eliminating the need for the spacer.

Figure 23A:
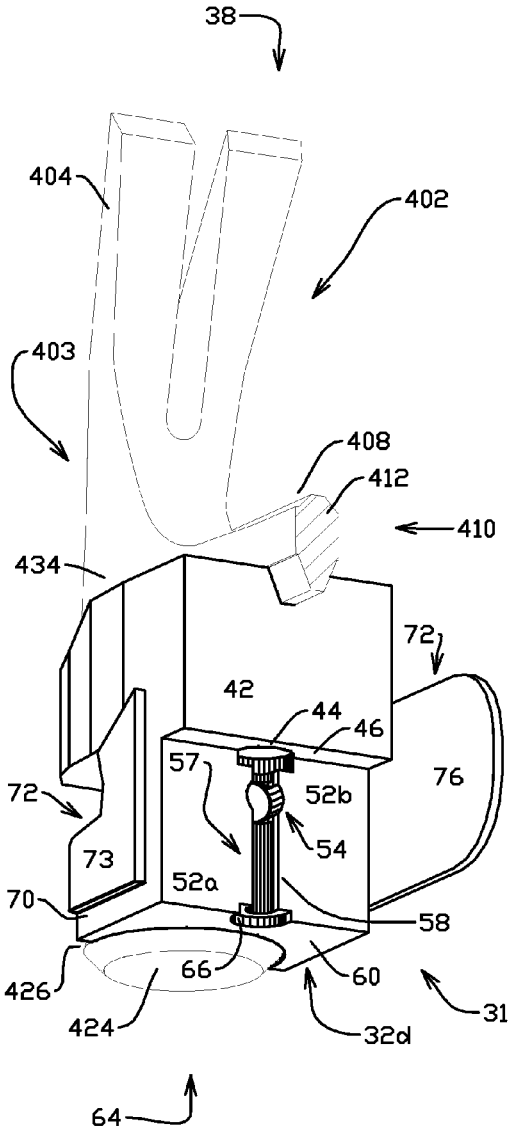
FIGS. 23A and 23B show the attachment, in perspective view from the front, lower, left-hand corner, and from the back, upper, left-hand corner, respectively, attached to a prior art, narrow-headed hammer, with the attachment made to specifically fit the narrow-headed hammer.
Figure 23B:
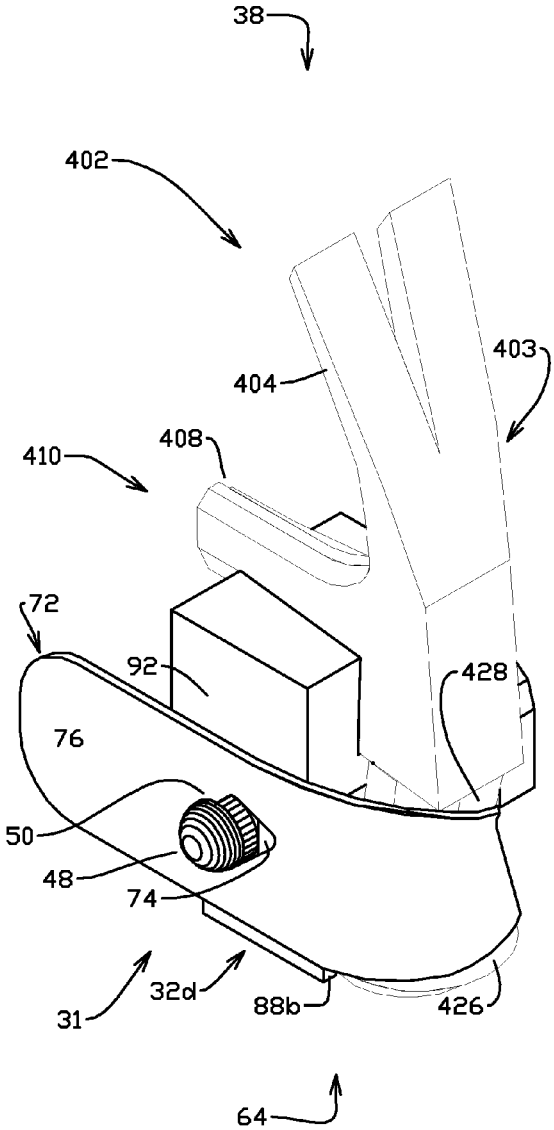

FIGS. 23A and 23B show essentially the same views as FIGS. 16A and 16B, except that the attachment is made in this case to specifically fit the narrow-headed hammer, eliminating the need for the spacer.

Operation—FIGS. 1, 4 through 10, and 14 through 16

Referring to FIG. 4, the attachment 31 is attached to a prior art, nonmetal-handled hammer 402 first by slipping the hammer poll 426 through the safety cord 68, from the upper end 38 towards the lower end 64. Then, in one motion, the poll and poll shoulder 420 are slid against the poll girdle 62 and the girdle shoulder 90 (FIG. 1) and the hammer sleeve 430 is slid against the sides and bottom of the sleeve/spacer receiving area 36 (FIG. 1). Then, while holding the attachment in this position, the outer strap end 76 can be grasped and the strap 72 pulled over and around the hammer throat 428 until the strap hole 74 is situated over the hook 48. Then, the strap is pulled towards the attachment body so that the hole slides over the hook. Lastly, the strap is released such that the elasticity of the strap pulls the edge of the hole up under the hook lip 50 thus securing the attachment to the hammer. The result of this action is shown from the front and from the back in FIGS. 5 and 6 respectively.

While the attaching of the attachment can be very easily done by using two hands, it can also be done quite easily with the use of only one hand. To use one hand, first, while in a squat or seated position, place the hammer on the user's lap with the poll up and the handle pointed away from the user. Then with one hand, grasp the attachment with the poll girdle up and the safety cord toward the user and slip the cord over the poll and slide the attachment into place on the hammer. Then, rotate the hammer and attachment to the left, laying them on their sides with the hook side up, the strap on the bottom, pointed towards the user, and the handle pointed away from the user and its end cradled between the knees. Then grasp the outer strap end, near the strap hole, between the thumb and forefinger, with the thumb on the outside of the strap and pointed to the user's side. Lastly, brace the middle finger against the upper front face of the attachment and pull the strap hole over the hook.

The attachment can be detached by basically reversing these steps.

Referring to FIG. 7A, a fastener can be inserted into the attachment in the following manner: grasp a fastener, such as a prior art, 16d common, nail-type fastener 502 as shown in the figure, by the shank 504. Then, in one motion, place the head 506 of the fastener against the upper face of the fastener-head pocket 44 and the shank against the back edge of the fastener-receiving slot 58. The fastener will then be held in place by the pull of the magnet 56 (FIG. 1A).

The fastener can now be started in a work piece with the use of only one hand. This is accomplished by taking a conventional swing with the hammer to start the fastener in the work piece at the desired starting point. At the moment when the fastener begins to penetrate the work piece, the user diverts the swing very slightly away from him and allows the momentum of the swing to pull the attachment away from the fastener. This will leave the fastener standing in the work piece.

The fastener, a nail 502 in the case of FIG. 7A, can then be struck on its head 506 with the striking face 424 of the hammer in the conventional manner with another swing to drive the nail further into the work piece. This is accomplished without any significant change in the rhythm of the swing. The nail can then be driven the rest of the way into the work piece in the usual manner with a smooth, continuous rhythm in the striking of the nail.

FIG. 7B shows the result after having attached the attachment and inserted a prior art, 1½" drywall, nail-type fastener 512 in a similar fashion as described above. The drywall nail can then be started with one hand and driven into the work piece to the desired depth as discussed above.

Similarly, FIGS. 8A and 8B show the results after attaching the attachment and inserting a prior art #10 3" 522 and a #10 1½" 532 flat wood screw, respectively.

FIG. 9A shows the results after attaching the attachment and inserting a prior art, cut-off 16d sinker, nail-type fastener-extender 542 in the same manner as described above.

FIG. 9B shows the results after attaching the attachment and inserting a prior art, cut-off 16d sinker, nail-type fastener-extender 542 and a prior art, #6 fine drywall, screw-type fastener 552. The fastener is too short to be placed with its head 556 against the upper face of the fastener-head pocket 44 and still extend sufficiently below the striking face 424 of the hammer. Therefore, the fastener head is placed against the upper edge of the slot mouth 66 and the cut-off end of the fastener-extender 542. Then the fastener can be started in the same manner as previously described.

Similarly, FIGS. 10A and 10B show the results of the shorter prior art fasteners, a #6 carpet/upholstery tack 562 and a #5 wire cloth staple 572, inserted respectively. These fasteners can then be started as previously described.

FIG. 14A shows the attachment 31 after the appropriate spacer 202 (FIG. 11) has been inserted into the sleeve/spacer receiving area 36 (FIG. 1) and the attachment has been attached to a prior art flat-handled hammer 402 (FIG. 2B). The spacer is inserted into the attachment by pointing the front of the spacer towards the back of the sleeve/spacer-receiving area of the attachment and sliding the bottom face of the spacer along the bottom face of the receiving area. The spacer is slid in until it snaps into place when the spacer bump 218 (FIG. 11) pops into the attachment dimple 82 (FIG. 1B). At this point, the spacer front face will be aligned with the attachment upper, front face. The spacer can be removed from the attachment by basically reversing these steps. The attaching to, and the use of the attachment with, the prior art flat-handled hammer are done in a similar manner as that described for the nonmetal-handled hammer of FIG. 4.

FIG. 14B shows this same setup, but from the back perspective view.

FIG. 15A shows the attachment 31 after the appropriate spacer 202 (FIG. 12) has been inserted into the sleeve/spacer receiving area 36 (FIG. 1) and the attachment has been attached to a prior art tubular-handled hammer 402 (FIG. 2C). The spacer is inserted into the attachment in the same manner as that described for the flat-handled hammer, FIG. 14A. The attaching to, and the use of the attachment with, the prior art tubular-handled hammer are done in a similar manner as that described for the nonmetal-handled hammer of FIG. 4.

FIG. 15B shows this same setup, but from the back perspective view.

FIG. 16A shows the attachment 31 after the appropriate spacer 202 (FIG. 13) has been inserted into the sleeve/spacer receiving area 36 (FIG. 1) and the attachment has been attached to a prior art narrow-headed hammer 402 (FIG. 2D). The spacer is inserted into the attachment in the same manner as that described for the flat-handled hammer, FIG. 14A. The attaching to the prior art narrow-headed hammer is done in a similar manner as that described for the nonmetal-handled hammer of FIG. 4, except for the following: once the hammer poll 426 is slipped through the safety cord 68, just past the poll shoulder 420, hold the lower edge of the poll against the poll girdle 62 and position the left edge of the hammer handle bottom 436 at the upper left corner of the spacer cradle surface 208 opening on the spacer upper front face 210. Then, with the spacer holding finger 234 just over the hammer throat notch 442, rotate the attachment about the pivot point where the poll rests against the girdle in a direction from the attachment lower end 64 towards the upper end 38 until the cradle surface contacts the handle bottom. This will seat the cradle surface against the hammer and place the spacer finger faces 240 and 242 into the hammer throat notch 442. The attachment can then be secured to the hammer with the attaching strap 72 in the same manner as that described for the nonmetal-handled hammer of FIG. 4. The use of the attachment with the prior art narrow-headed hammer is also done in a similar manner as that described for the nonmetal-handled hammer of FIG. 4.

FIG. 16B shows this same setup, but from the back perspective view.

The attachment can be detached by basically reversing the above steps.

All of the above preferred embodiment descriptions and the operation of the attachment have been tested successfully with a prototype using the appropriate building material, such as wood or drywall. The tests were conducted in various positions, including overhead, to the side, and below the usual hammer swing area. Successful tests were also made using dome-headed screws (versus flat-headed), ranging in size from small, #9 ⅞-inch, to large, #10 2-inch sizes.

ADVANTAGES

From the description above, a number of advantages of my one-hand fastener-starting hammer attachment become evident:

1. The attachment will be securely attached to the hammer so that the chances of it becoming detached during use are very low.
2. The attachment will have a back-up safety mechanism to prevent the attachment from flying off in the event it becomes detached during use.
3. The attachment will have a securing mechanism of such a design, and will employ such a material, that a high number of attachment-detachments would be possible before the mechanism failed.
4. The attachment would withstand a large amount of attaching and detaching.
5. The attachment would be composed of materials possessing relatively high strength and durability properties.
6. The attachment could be used with a wide variety of hammer types and shapes, including all of the common household types.
7. The attachment will not require a great degree of precision in design or manufacture, resulting in increased likelihood that the attachment will function in the manner intended.
8. The attachment could remain on the hammer without interference when continuing to strike a nail with the face in the conventional manner to drive the nail into its final position.
9. The attachment will not interfere with the starting of the next fastener if it is not needed.
10. The attachment will not require an additional step or significant movement to release a nail from the attachment before continuing to hammer the nail into place in the conventional manner with a smooth, continuous rhythm in the striking of the nail.
11. The attachment will hold a large fastener in all positions of the hammer, including when the work area is above, below, or to the side of the user.
12. The attachment will allow one to continue to swing the hammer in the same plane as that used in the first swing when starting a nail, so that a rhythm is employed when striking the nail with the face to drive it to its final position.
13. The attachment will allow a fastener to be started with the hammer in the conventional striking position, thus requiring less than half the width of area for the swing as that needed when using the cheek of the hammer.
14. The attachment will be simple in that it would require the user to place the fastener in one obvious location every time, regardless of where the work area is relative to the user.
15. The attachment will be such that the insertion of a fastener is so simple that it can be easily done with one hand.
16. The attachment will be so easy to attach to the hammer that it could be done with one hand.
17. The attachment could be left attached without interfering with the use of the claw by preventing the claw from grasping the fastener.
18. The attachment could be left attached without interfering with the use of the claw by jamming or damaging the attachment.
19. The attachment could be left attached without interfering with the use of the claw by marring a work surface.
20. The attachment will be so easy to remove from a hammer that it could be removed with one hand.
21. The attachment would not fit over the face and would not receive repeated impacts in the striking of a nail with the face to drive the nail to its final position.
22. The attachment will have smooth edges and corners that will not snag on or abrade or cut the user, his clothing, the hammer holster, other tools, or the toolbox.
23. The attachment will have its magnet completely shielded by nonmagnetic material, except a small recessed area, thus greatly reducing the chance to attract metallic objects when not desired.
24. The attachment will contain a magnet that does not receive repeated impact, leading to loss of magnetism.
25. The attachment will contain nonmagnetic material between its magnet and the hammerhead so that it will not lead to accumulation of residual magnetism by the hammerhead, resulting in the hammer attracting other metallic items when not desired.
26. The attachment will be simple in design and constructed of inexpensive materials, resulting in a low manufacturing cost.
27. The attachment, in the event of its failure, could be easily replaced in its entirety, because of its low cost.
28. The attachment would accept and hold a broader-bodied or larger-head type fastener, such as a screw.
29. The attachment would accommodate staples.
30. The attachment would accept and hold, and allow the starting of small, short fasteners, including carpet tacks.

The following are further objects and advantages. The attachment will be easy and convenient to use and to store. When not in use, the attachment could be easily stored in a toolbox, kit, drawer or apron, or could be hung from a hook, on a wall or on the user, by the hole in the attaching strap. The attachment could be supplied in one package containing the attachment and the three spacers that allow the use of the attachment with all of the common household hammers. Or, the spacers could be packaged separately from the attachment. Or, instead of the three spacers, three additional attachments, each built to fit the three different, additional hammers, could be packaged separately.

CONCLUSION, RAMIFICATIONS, AND SCOPE

Accordingly, the reader will see that the fastener-starting attachment of this invention can be easily attached to any of the conventional household hammers on the market today, and easily used with one hand to start a variety of fasteners, including large or small, long or short, nails, screws, staples, or tacks. When not needed, it can just as easily be removed with the use of only one hand. Furthermore, the fastener-starting attachment has the additional advantages in that

- it permits the production of an attachment that can be securely attached to the hammer to greatly diminish the chance for unwanted detachment during use;
- it provides a back-up safety mechanism to prevent the attachment from flying off in the outside possibility that it became detached during use;
- it provides a securing mechanism that would allow numerous attachment-detachments before possible failure of the mechanism occurred;
- it provides an attachment that itself would withstand many attachments and detachments;
- it provides an attachment that can be made of materials of high strength and durability;
- it provides an attachment that can be used with all of the common household types of hammers in use today;
- it provides an attachment that requires a low degree of precision in design and manufacture, leading to a high probability that it would perform as intended;
- it provides an attachment that allows it to remain on the hammer without interference when continuing to drive in a nail in the usual manner;

it provides an attachment that allows the starting of the next fastener without interference if it is not needed;

it allows the release of a nail from the attachment before continuing to hammer the nail into place with a smooth, continuous rhythm;

it allows the holding of a large fastener without special considerations even when the hammer is employed above the user's head, below his feet, or to the side of the user;

it will allow one to continue the hammer swing in the same plane as that used in the first swing when starting a nail, so that a smooth rhythm is maintained when continuing to strike the nail;

it allows a fastener to be started with the hammer striking face in the conventional manner rather than with the hammer cheek, which requires more than twice the width for the swing;

it allows the fastener to be placed on the attachment in one obvious location every time, no matter whether the hammer is to be used above, below, or to the side of the user;

it allows the easy insertion of a fastener with the use of only one hand;

it allows the attachment to be easily attached to a hammer with the use of only one hand;

it provides an attachment that can be left attached to a hammer without interfering with the ability of the claw to grasp a fastener when the hammer is being used to pull out a fastener with the claw in the usual manner;

it provides an attachment that can be left attached while using the claw without jamming or damaging the attachment;

it provides an attachment that can be left attached while using the claw without marring a work surface;

it provides an attachment that can be easily removed with the use of only one hand;

it provides an attachment that attaches out of the way of the striking face of a hammer and therefore is not prone to failure due to repeated impacts when striking of a nail with the face to drive the nail further into the work piece;

it provides an attachment that is made such that it has smooth edges and corners that will not snag on or abrade or cut the user, his clothing, the hammer holster, other tools, or the toolbox;

it provides an attachment that has its magnet surrounded by nonmagnetic material, aside from a small indented portion, therefore significantly decreasing the likelihood that it will undesirably attract other magnetic items;

it contains a magnet that is located where it will not be impacted whenever a fastener is struck with the hammer, which would result in magnetism attenuation;

it contains nonmagnetic material between the magnet and the hammerhead so that hammerhead does not acquire residual magnetism which would cause the hammer to inopportunely attract other magnetic items;

it allows a low manufacturing cost due to its simple design and its use of inexpensive materials in its construction;

it provides an attachment that due to its low cost one would elect to completely replace it rather than attempt to replace a part that may have failed;

it provides an attachment that would accept and hold broad-bodied and large-head type fasteners such as screws;

it allows the starting of fasteners that are more complex than single-shank nails and screws, such as staples;

it allows the holding and starting of small, short fasteners, such as carpet tacks;

it provides an attachment that could be supplied in a variety of ways, including: (a) a package that contained the attachment and the three spacers, (b) a package that contained the attachment and a package containing the three spacers, (c) a package that contained the attachment and three separate packages, each containing one of the spacers, and (d) a package that contained the basic attachment and three separate packages, each containing an attachment built to fit one of the three different, additional hammers;

it provides an attachment that when not in use could be easily kept in an apron, toolbox, kit, or drawer, or the attaching strap hole could be slipped over a hook on the user's tool belt or over a wall hook.

While the forgoing discusses the details of the presently preferred, and possible additional and alternative embodiments of this invention, these should not be construed as limiting the scope of the invention but as merely providing illustrations of some of the possible embodiments of this invention. There are numerous other minor variations that can be made if desirable. For example, changes in the basic shape or dimensions could be made to the attachment body, attaching strap, and/or spacers. The sides of the sleeve/spacer receiving area could be made higher, or lower. The spacer-guiding grooves could have different shapes or locations, or possibly eliminated. The fastener-receiving slot could also have a different shape or location. It may be desirable to make the attachment smaller, or conversely, larger. A piece of harder, more durable material could be placed at the upper end of the fastener-head pocket. It may be desirable to shift the fastener-head pocket and the fastener-holding apparatus downward 1/16 to 1/8 inch to allow the point of a 1½-inch long fastener to protrude further beyond the hammer striking face. In addition, the use of an extender about 7/32 inches longer allows the starting of a fastener as short as a 5/16-inch long thumbtack. Also, the extender can be used in the inverted position. It may also be desirable to add 1/16-1/8 inch, or more, to the exposed length of the safety cord to ease the slipping of the hammer poll through the safety cord. It may also be desirable to thicken by 1/16-1/8 inch, or more, the portion of the attachment body where the magnet is affixed within the receptacle, to ensure that the magnet is sufficiently shielded.

Thus the scope of the invention should be determined by the appended claims and their legal equivalents, rather than by the examples given.

I claim:

1. An attachment for use with an unmodified nonmetal-handled hammer that allows the starting of a fastener, including a nail, a screw, a tack, and a staple, in a work piece, and allows the continuation of driving in said fastener with the bare striking face of said hammer with said attachment still attached, with the use of only one hand, said attachment being attached to said hammer adjacent to the head of said hammer, said attachment comprising:

a. a body having a first surface sized to fit about at least a portion of the region of said head of said hammer where the neck and throat join the poll and a second surface sized to fit about at least a portion of the region of said head of said hammer where the upper portion of the neck and throat join the rest of the hammer head said body located external of any part of said striking face, and having at least one face located to the side of said poll and external of any part of said striking face, said at least one face having at least one fastener-receiving region that receives said fastener with its shank parallel to the axis of said poll, and at least one fastener-holding apparatus located to the side of said poll, external to any part of said striking face and that holds said shank parallel to the axis of said poll, and b. at least one attaching mechanism located around said throat and external of any part of said striking face, whereby said body can be attached to, and unattached from, said unmodified hammer with the use of only one hand.

2. The attachment of claim 1 further including at least one hammer-to-attachment spacer having a first surface sized to fit against at least a portion of said second surface of said body of said attachment, and a second surface sized to fit about at least a portion of the region of the head of a hammer where the upper portion of the neck and throat join the rest of the hammer head, said hammer selected from the group of metal-handled hammers consisting of a) a flat-handled hammer, b) a tubular-handled hammer, and c) a narrow-headed hammer, whereby said hammer-to-attachment spacers allow said attachment to fit said hammers.

3. The attachment of claim 1 wherein said body is made of plastic.

4. The attachment of claim 1 wherein said body is made of material selected from the group consisting of a) wood, b) rubber, c) copper, d) brass, and e) aluminum.

5. The attachment of claim 1 wherein said fastener-receiving region comprises at least one slot.

6. The fastener-receiving region of claim 5 wherein said slot has at least one fastener head pocket, whereby said pocket supports the head of said fastener.

7. The fastener-receiving region of claim 5 wherein said slot has at least one mouth.

8. The attachment of claim 1 wherein said fastener-holding apparatus comprises at least one magnet.

9. The attachment of claim 1 further including at least one safety cord, whereby said safety cord prevents said attachment from flying off during use in the event of failure of said attaching mechanism.

10. The attachment of claim 1 wherein said attaching mechanism comprises at least one strap.

11. The attaching mechanism of claim 10 wherein said strap is made of rubber.

12. The attaching mechanism of claim 10 wherein said strap is made of material selected from the group consisting of a) leather, b) cloth, c) plastic, d) hook-and-loop fastener material, and e) metal.

13. The attaching mechanism of claim 10 wherein said strap is comprised of at least one screw-type strap clamp.

14. The attachment of claim 1 wherein said fastener-holding apparatus comprises at least one magnet and said fastener receiving region comprises a head pocket, said fastener holding apparatus further comprises at least one magnetism and support extender, whereby the magnetism of said magnet and the support of a head pocket are extended toward said mouth of a attachment.

15. An attachment to be connected next to the head of an unaltered nonmetal-handled hammer that makes it possible to initiate a fastener, including a nail, a screw, a tack, and a staple, in a board or other surface, and allows the continuation of driving in said fastener with the bare striking face of said hammer with said attachment still attached, while employing just one hand, said attachment comprising:

a. a body with a surface two sized to fit about at least a portion of the region of said head of said hammer where the upper portion of the neck and throat join the rest of the hammer head, and surface one sized to fit about at least a portion of the region of said head of said hammer where the neck and throat join the poll, said body located external of any part of said striking face and having at least one face located to the side of said poll and external of any part of said striking face, said at least one face having at least one fastener-accepting area that receives said fastener with its shank parallel to the axis of said poll, and at least one fastener-handling unit, located to the side of said poll, external to any part of said striking face and that holds said shank parallel to the axis of said poll, and b. at least one connecting apparatus located around said throat and external of any part of said striking face, whereby said body can be connected to, and unconnected from, said unaltered hammer while employing just one hand.

16. The attachment of claim 15 wherein said fastener-handling unit comprises at least one set of flexible holding fingers.

17. The attachment of claim 15 wherein said connecting apparatus comprises at least one bolt and nut.

18. A method of transforming an unmodified hammer in such a manner that said hammer can be used to start a fastener, including a nail, a screw, a tack, and a staple, in a work piece, and allows the continuation of driving in said fastener with the bare striking face of said hammer with said attachment still attached, with the use of only one hand, said method comprising:

a. providing an attachment of the type comprising a body having a first surface formed to fit about at least a portion of the region of said head of said hammer where the neck and throat join the poll and a second surface formed to fit about at least a portion of the region of the head of a hammer where the upper portion of the neck and throat join the rest of the hammer head, said body located external of any part of said striking face, said hammer selected from the group of hammers consisting of a) a nonmetal-handled hammer, b) a flat-handled hammer, c) a tubular-handled hammer, and d) a narrow-headed hammer, and having at least one face located to the side of said poll and external of any part of said striking face, said at least one face having at least one fastener-receiving region that receives said fastener with its shank parallel to the axis of said poll, and at least one fastener-holding apparatus, located to the side of said poll, external to any part of said striking face and that holds said shank parallel to the axis of said poll, and at least one attaching mechanism located around said throat and external of any part of said striking face, b. providing a hammer and a fastener, c. placing said first surface of said body against said region of said head of said hammer where the neck and throat join the poll and said second surface of said body against said region of said head of said hammer where the upper portion of the neck and throat join the rest of the hammer head, d. attaching said attachment to said hammer with said attaching mechanism, and e. inserting said fastener into said fastener-receiving region, said fastener being held by said fastener-holding apparatus, whereby said attachment can be attached to, and unattached from, said unmodified hammer with the use of only one hand, without altering the hammer itself.

19. The method of claim 18 wherein said body is made of plastic.

20. The method of claim 18 wherein said fastener-holding apparatus comprises at least one magnet.

* * * * *